US009239534B2

(12) United States Patent
Seto

(10) Patent No.: US 9,239,534 B2
(45) Date of Patent: Jan. 19, 2016

(54) CLEANING DEVICE AND IMAGE FORMING APPARATUS EQUIPPED WITH THE SAME

(71) Applicant: CANON KABUSHIKI KAISHA, Tokyo (JP)

(72) Inventor: Masaki Seto, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/092,066

(22) Filed: Nov. 27, 2013

(65) Prior Publication Data

US 2014/0153988 A1 Jun. 5, 2014

(30) Foreign Application Priority Data

Nov. 30, 2012 (JP) ..... 2012-263261
Oct. 22, 2013 (JP) ..... 2013-219645

(51) Int. Cl.
*G03G 21/00* (2006.01)
*G03G 15/04* (2006.01)

(52) U.S. Cl.
CPC ..... *G03G 15/04045* (2013.01); *G03G 21/0011* (2013.01); *G03G 2215/0402* (2013.01); *G03G 2221/1636* (2013.01); *G03G 2221/1654* (2013.01)

(58) Field of Classification Search
CPC ..... G03G 15/04045; G03G 21/0011; G03G 2215/0402; G03G 2221/1654
USPC ..... 399/71, 99
See application file for complete search history.

(56) References Cited

U.S. PATENT DOCUMENTS

| | | | | |
|---|---|---|---|---|
| 7,853,170 | B2 | 12/2010 | Ueda | |
| 7,995,946 | B2 | 8/2011 | Ueda | |
| 2005/0163518 | A1* | 7/2005 | Onose et al. | 399/49 |
| 2008/0286001 | A1* | 11/2008 | Matsumoto et al. | 399/112 |
| 2009/0087210 | A1* | 4/2009 | Terao et al. | 399/99 |

FOREIGN PATENT DOCUMENTS

| | | | |
|---|---|---|---|
| JP | 2005-041147 | A | 2/2005 |
| JP | 2008-242432 | A | 10/2008 |

* cited by examiner

*Primary Examiner* — Ryan Walsh
(74) *Attorney, Agent, or Firm* — Canon USA Inc. IP Division

(57) ABSTRACT

A cleaning device includes a cleaning unit configured to perform cleaning while in contact with a light transmission member, the cleaning unit being movable with respect to the transmission member in a first direction and a second direction differing in orientation. The cleaning unit includes a first cleaning portion and a second cleaning portion capable of coming into contact with the transmission member, moves in the first direction while keeping the first cleaning portion in contact with the transmission member and keeping the second cleaning portion away from the transmission member, and moves in the second direction while keeping the first cleaning portion away from the transmission member and keeping the second cleaning portion in contact with the transmission member.

34 Claims, 25 Drawing Sheets

CLEANING DEVICE AND IMAGE FORMING APPARATUS EQUIPPED WITH THE SAME

BACKGROUND OF THE INVENTION

1. Field of the Invention

The present invention relates to a cleaning device for a light transmission member, and to an electrophotographic image forming apparatus such as a laser printer, a facsimile apparatus, or a copying machine equipped with the same.

2. Description of the Related Art

Conventionally, an apparatus equipped with a light transmission member has been equipped with a cleaning device for removing a stain on the transmission member. For example, in an electrophotographic image forming apparatus, there is provided, at a light irradiation opening of a light irradiation unit for irradiating a photosensitive member with light, a light transmission member such as a cover glass, in order that foreign matter such as toner and dust scattered within the apparatus may not enter the light irradiation unit, with there being provided a cleaning mechanism for cleaning the transmission member.

Japanese Patent Application Laid-Open No. 2008-242432 discusses a configuration in which, in order that a reduction in image density or partial image omission may not be caused by foreign matter adhering to the transmission member, a cleaning member having contact with the transmission member is configured to make a reciprocating movement by inserting and extracting a cartridge into and out of the apparatus main body, thereby removing foreign matter adhering to the transmission member. Further, according to Japanese Patent Application Laid-Open No. 2008-242432, this configuration also prevents the foreign matter which adheres to the cleaning member at the time of cleaning of the transmission member from adhering to the transmission member again, thereby protecting the transmission member from being soiled. More specifically, on the forward way (at the time of insertion of the cartridge), the cleaning member is held in contact with the transmission member to clean the transmission member, and, on the backward way (at the time of extraction of the cartridge), the cleaning member is spaced away from the transmission member so that the cleaning member is restored to a cleaning start position without cleaning the transmission member.

However, in the configuration of Japanese Patent Application Laid-Open No. 2008-242432, in which, in order that the foreign matter adhering to the cleaning member may not be allowed to adhere to the transmission member again, the cleaning member is configured to clean the transmission member solely on the forward way (at the time of insertion of the cartridge), and is not configured to clean it on the backward way (at the time of extraction of the cartridge). The frequency of cleaning is therefore rather low with respect to the number of times that the cleaning member is moved, so that there is a fear of the transmission member not being sufficiently cleaned.

In recent years, in particular, in order to suppress the increase in the interior temperature of the apparatus due to the recent increase in the operating speed of image forming apparatuses, there is a tendency for the amount of cooling air blown within the apparatus to increase, with the result that foreign matter such as toner and dust within the apparatus is likely to be scattered, making the transmission member more subject to staining. Further, depending upon the arrangement of the light irradiation unit inside the apparatus, the configuration of the cartridge, and the direction of the airflow inside the apparatus, there are cases where the transmission member is subject to staining even when the amount of air blown is not large.

The above problem might be solved by increasing the frequency at which cleaning is performed by the cleaning member. One possible method of doing so might be to bring the cleaning member into contact with the transmission member in both the forward and backward ways. However, as described above, simply bringing the cleaning member into contact with the transmission member in both the forward and backward ways would result in the foreign matter which adheres to the cleaning member on the forward way being allowed to adhere to the transmission member again on the backward way, thus staining the transmission member.

Another possible method of increasing the cleaning frequency might be to increase the number of times that the cleaning member is moved. However, in a configuration in which the movement of the cleaning member is performed in relation to the movement of another component (e.g., the cartridge), the movement frequency of the cleaning member depends on the movement frequency of that component, which means it is rather difficult to enhance solely the movement frequency of the cleaning member alone. Even if there is to be provided a dedicated operation for moving the cleaning member, there will be involved a problem due to an increase in the frequency of the operation. For example, there will be involved an increase in the time period in which image formation cannot be executed due to the movement of the cleaning member. In the case where it is a user or a serviceman that executes the operation, the burden on the user or the serviceman would increase.

SUMMARY OF THE INVENTION

The present invention is directed to a cleaning device making it possible to increase the cleaning frequency of the cleaning device with respect to the number of times that the cleaning member is moved while suppressing adhesion of foreign matter adhering to the cleaning member at the time of cleaning of the transmission member from being allowed to adhere to the transmission member again to thereby stain the transmission member.

According to an aspect of the present invention, a cleaning device includes a cleaning unit configured to perform cleaning while in contact with a light transmission member, the cleaning unit being movable with respect to the transmission member in a first direction and a second direction differing in orientation, and a first cleaning portion and a second cleaning portion provided in the cleaning unit and capable of coming into contact with the transmission member. The cleaning unit moves in the first direction while keeping the first cleaning portion in contact with the transmission member and keeping the second cleaning portion away from the transmission member, and moves in the second direction while keeping the first cleaning portion away from the transmission member and keeping the second cleaning portion in contact with the transmission member.

According to another aspect of the present invention, a cleaning device includes a cleaning unit configured to perform cleaning while in contact with a light transmission member, the cleaning unit being movable with respect to the transmission member in a first direction and a second direction differing in orientation, a moving member provided in the cleaning unit and movable in the first direction and the second direction within an image forming apparatus main body, and a cleaning portion provided in the cleaning unit and capable of being changed in position with respect to the moving member. The positions of the cleaning portion with respect to the moving member when the cleaning unit is moving in the first direction differ from those when the cleaning unit is moving in the second direction.

According to yet another aspect of the present invention, an image forming apparatus includes a photosensitive member, a light transmission member, a light irradiation device configured to apply the light transmitted through the transmission member to the photosensitive member to form an image by causing toner to adhere to the irradiated photosensitive member, a cleaning unit configured to perform cleaning while in contact with a transmission member, the cleaning unit being movable with respect to the transmission member in a first direction and a second direction differing in orientation, and a first cleaning portion and a second cleaning portion provided in the cleaning unit and capable of coming into contact with the transmission member. The cleaning unit moves in the first direction while keeping the first cleaning portion in contact with the transmission member and keeping the second cleaning portion away from the transmission member, and moves in the second direction while keeping the first cleaning portion away from the transmission member and keeping the second cleaning portion in contact with the transmission member.

According to yet another aspect of the present invention, a cleaning device includes a cleaning unit configured to perform cleaning while in contact with a light transmission member, the cleaning unit being configured to move in conjunction with attachment and detachment of a cartridge to and from an apparatus main body and movable with respect to the transmission member in a first direction and a second direction differing in orientation, and a cleaning portion provided in the cleaning unit and capable of coming into contact with the transmission member. The cleaning unit moves in the first direction while keeping the cleaning portion in contact with the transmission member, and moves in the second direction while keeping the cleaning portion away from the transmission member.

According to yet another aspect of the present invention, an image forming apparatus includes a photosensitive member, a light transmission member, a light irradiation device configured to apply the light transmitted through the transmission member to the photosensitive member to form an image by causing toner to adhere to the irradiated photosensitive member, a cleaning unit configured to perform cleaning while in contact with the transmission member, the cleaning unit being configured to move in conjunction with attachment and detachment of a cartridge to and from the apparatus main body and movable with respect to the transmission member in a first direction and a second direction differing in orientation, and a cleaning portion provided in the cleaning unit and capable of coming into contact with the transmission member. The cleaning unit moves in the first direction while keeping the cleaning portion in contact with the transmission member, and moves in the second direction while keeping the cleaning portion away from the transmission member.

Further features of the present invention will become apparent from the following description of exemplary embodiments with reference to the attached drawings.

DESCRIPTION OF THE EMBODIMENTS

A first exemplary embodiment of the present invention will be described. In the following description, when illustrating directions, etc. regarding the apparatus, three directions of X, Y, and Z directions, which are at right angles to one another, will be adopted as common directions as a reference. In the present exemplary embodiment, as illustrated in the diagrams, the directions of arrows will be referred to as + (plus) directions, and the directions opposite the arrows will be referred to as − (minus) directions.

[Overall Construction of an Image Forming Apparatus 100]

Figure 1:
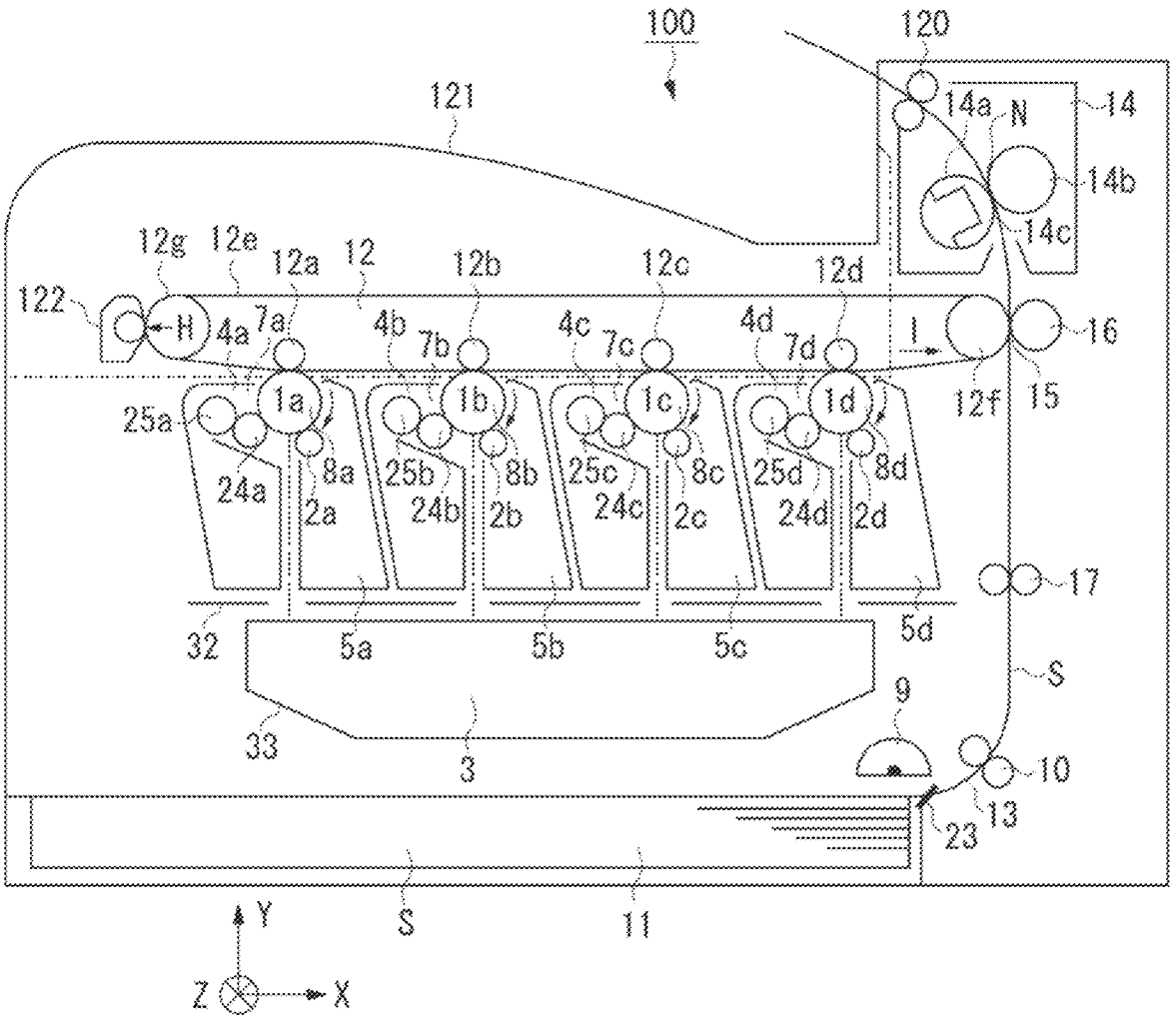
FIG. 1 is a schematic sectional view of an image forming apparatus.

The present exemplary embodiment is applied to an image forming apparatus 100, which functions as a color laser printer, and the overall construction of the apparatus will first be schematically described. FIG. 1 is a schematic sectional view of the image forming apparatus 100. The image forming apparatus is mainly equipped with an optical unit 3, a feeding device 13, a fixing device 14, and a secondary transfer unit 15. Further, the image forming apparatus 100 includes four detachable cartridges 7*a*, 7*b*, 7*c*, and 7*d*. Each cartridge 7 (7*a*, 7*b*, 7*c*, or 7*d*) is a displaceable component in which a photosensitive drum 1 (1*a*, 1*b*, 1*c*, or 1*d*), a developing unit 4 (4*a*, 4*b*, 4*c*, or 4*d*), and a cleaner unit 5 (5*a*, 5*b*, 5*c*, or 5*d*) are formed into a single unit. Each cartridge 7 (7*a*, 7*b*, 7*c*, or 7*d*) is a process cartridge integrally supporting a charging roller 2 (2*a*, 2*b*, 2*c*, or 2*d*), a developing roller 24 (24*a*, 24*b*, 24*c*, or 24*d*), and a cleaning blade 8 (8*a*, 8*b*, 8*c*, or 8*d*), all of which constitute a process unit acting on the corresponding photosensitive drum 1.

The four cartridges 7*a*, 7*b*, 7*c*, and 7*d* differ from each other in that they store toners of different colors of yellow (Y), magenta (M), cyan (C), and black (Bk). Otherwise, they are of the same structure. Thus, when describing the construction, etc. common to the cartridges 7*a*, 7*b*, 7*c*, and 7*d*, the letters, a, b, c, and d may be omitted, and the "developing unit 4 (4*a*, 4*b*, 4*c*, or 4*d*)," for example, may be simply referred to as the "developing unit 4," with no letter being added to the reference numeral.

Inside the cartridge 7, the photosensitive drum 1 rotates in the direction of the arrow in FIG. 1 (clockwise), and the rotation axis of the photosensitive drum 1 is parallel to the Z direction in the state in which the cartridge 7 has been attached to the image forming apparatus 100 (hereinafter referred to as the apparatus main body 100). Inside the cartridge 7, there are arranged around the photosensitive drum 1 the charging roller 2, the developing roller 24, and the cleaning blade 8 in that order in the rotational direction of the photosensitive drum 1. The cartridge 7 is inserted and extracted into and from the apparatus main body 100 in the direction of the rotation axis of the photosensitive drum 1, whereby the cartridge 7 can be attached and detached to and from the apparatus main body 100.

The developing unit 4 (4*a* through 4*d*) has the developing roller 24 (24*a* through 24*d*), and a developer application roller 25 (25*a* through 25*d*), with toner being stored in the frame member thereof.

The cleaner unit 5 (5*a* through 5*d*) has the charging roller 2 (2*a* through 2*d*), and the cleaning blade 8 (8*a* through 8*d*), and can store the toner scraped off from the photosensitive drum 1 by the cleaning blade 8. The charging roller 2 is an electrically-conductive roller formed in a roller configuration. The photosensitive drum 1, which functions as an image bearing member, is formed by applying an organic photo conductive (OPC) layer to the outer peripheral surface of an aluminum cylinder.

Both end portions of the photosensitive drum 1 is rotatably supported by the frame member of the cleaner unit 5. By transmitting drive force from a drive motor (not illustrated) provided inside the apparatus main body 100 to one end thereof, the photosensitive drum is rotated in the direction of the arrow in FIG. 1 (clockwise).

The construction of the cartridge 7 is not restricted to the above-described one. That is, it is only necessary for the cartridge 7 to be equipped with the photosensitive drum 1 and at least one of the process units (the charging roller 2, the developing roller 24, and the cleaning blade 8) acting on the photosensitive drum 1. The cartridge 7 is not necessarily equipped with the photosensitive drum 1 and may be equipped with only the developing unit 4 and/or the cleaner unit 5.

The optical unit 3 functioning as a light irradiation unit is provided below the cartridge 7. It is a scanner having, inside a casing 33 thereof, a laser light source (not illustrated), a polygon mirror or some other mirror, and an image forming member such as a lens. The optical unit 3 polarizes the laser light emitted from the laser light source by the polygon mirror, and applies the laser light to the photosensitive drum 1 via the mirror and the lens, thereby performing scanning based on image information.

An intermediate transfer belt unit 12 is arranged above each cartridge 7. An intermediate transfer belt 12*e* is stretched between a driving roller 12*f* and a tension roller 12*g*, and the tension roller 12*g* exerts tension in the direction of an arrow H. The surface of the intermediate transfer belt 12*e* rotates in the direction of an arrow I in FIG. 1. In the intermediate transfer belt unit 12, there are arranged, on the inner side of the intermediate transfer belt 12*e*, primary transfer rollers 12*a*, 12*b*, 12*c*, and 12*d* arranged opposite each photosensitive drum 1. The photosensitive drums 1 and the primary transfer rollers 12*a*, 12*b*, 12*c*, and 12*d* pinch the intermediate transfer belt 12*e*, respectively forming primary transfer units. Further, the driving roller 12*f* and the secondary transfer roller 16 pinch the intermediate transfer belt 12*e* to thereby form the secondary transfer unit 15.

The feeding device 13 has a feeding roller 9 configured to feed a sheet S from within a feeding cassette 11 storing the sheet S, and a conveyance roller pair 10 configured to convey the sheet S fed. The feeding cassette 11 allows extraction in the direction of the front side of the main body in FIG. 1 (the direction of the rotation axis of the photosensitive drum 1). A user extracts the feeding cassette 11 and detaches it from the apparatus main body 100, and then sets the sheets S therein before inserting it into the apparatus main body 100, whereby the replenishment of the sheets is completed.

The fixing device 14 is provided on the downstream side of the secondary transfer unit 15 in the conveyance direction of the sheet S. The fixing device 14 has a rotatable fixing film 14*a*, a fixing roller 14*b*, and a heater 14*c* provided on the inner side of the fixing film 14*a*, and these components form a fixing nip portion N configured to nip and convey the conveyed sheet S.

The image formation on the sheet (recording material) S is performed by executing the following process while rotationally driving the photosensitive drum 1.

The charging roller 2 is brought into contact with the surface of the photosensitive drum 1, and a charging bias voltage is applied thereto by a power source (not illustrated) provided in the apparatus main body 100, whereby the surface of the photosensitive drum 1 is uniformly charged (charging step).

The optical unit 3 arranged below the cartridge 7 applies laser light, based on an image signal, to the photosensitive drum 1 the surface of which is charged by the charging roller 2 to thereby form an electrostatic latent image corresponding to the image signal on the photosensitive drum 1 (exposure step). In this way, the photosensitive drum 1 is charged to a predetermined electric potential of negative polarity by the charging roller 2 in the charging step, and then electrostatic latent images are respectively formed by the optical unit 3 on the photosensitive drums 1 in the exposure step.

Toner of negative polarity is caused to adhere to the electrostatic latent images formed on the photosensitive drums 1 by the developing roller 24. As a result, toner images of Y, M, C, and Bk colors are respectively formed on the photosensitive drums 1.

Next, a bias of positive polarity is applied to the primary transfer rollers 12*a*, 12*b*, 12*c*, and 12*d* in the state in which the photosensitive drums 1 is rotating in the direction of the arrow, and the surface of the intermediate transfer belt 12*e* is rotating in the direction of the arrow I. As a result, the toner images on the photosensitive drums 1 are primarily transferred to the surface of the intermediate transfer belt 12*e* (primary transfer step). In this process, the toner images on the photosensitive drums 1 are successively transferred in the order of the photosensitive drums 1*a*, 1*b*, 1*c*, and 1*d* so that the toner images on the photosensitive drums 1 may be superimposed one upon the other on the surface of the intermediate transfer belt 12*e* to thereby form a four-color toner image. The four-color toner image thus obtained is conveyed to the secondary transfer unit 15 through the rotation of the surface of the intermediate transfer belt 12*e*.

The sheets S stored in the feeding cassette 11 are held in press contact with the feeding roller 9, and are conveyed separately one by one by a separation pad 23 (This system is called a friction piece separation system). And, each sheet S conveyed from the feeding device 13 is conveyed to the secondary transfer unit 15 by a registration roller pair 17 in synchronism with the four-color toner image on the intermediate transfer belt 12*e*. At the secondary transfer unit 15, a bias of positive polarity is applied to the secondary transfer roller 16, whereby the four-color toner image on the intermediate transfer belt 12*e* is secondarily transferred to the conveyed sheet S (secondary transfer step).

After this, the sheet S is conveyed to the fixing nip portion N in the fixing device 14. At the fixing nip portion N, the sheet S is pinched by the fixing film 14*a* and the fixing roller 14*b* and, while it is thus pressurized, the sheet is heated by the heat of the heater 14*c*, with the unfixed toner image on the sheet S being fixed to the sheet S. The sheet S having left the fixing device 14 is discharged onto a discharge tray 121 by a discharge roller pair 120.

On the other hand, the toner remaining on the surface of the photosensitive drum 1 after the primary transfer is scraped off by the cleaning blade 8, and is recovered to the cleaner unit 5. The toner remaining on the surface of the intermediate transfer belt 12*e* after the secondary transfer is scraped off by a belt cleaning device 122, and is recovered to a waste toner recovery container (not illustrated) in the apparatus main body 100.

[Cleaning Mechanism for a Cover Glass 31]

Figure 2:
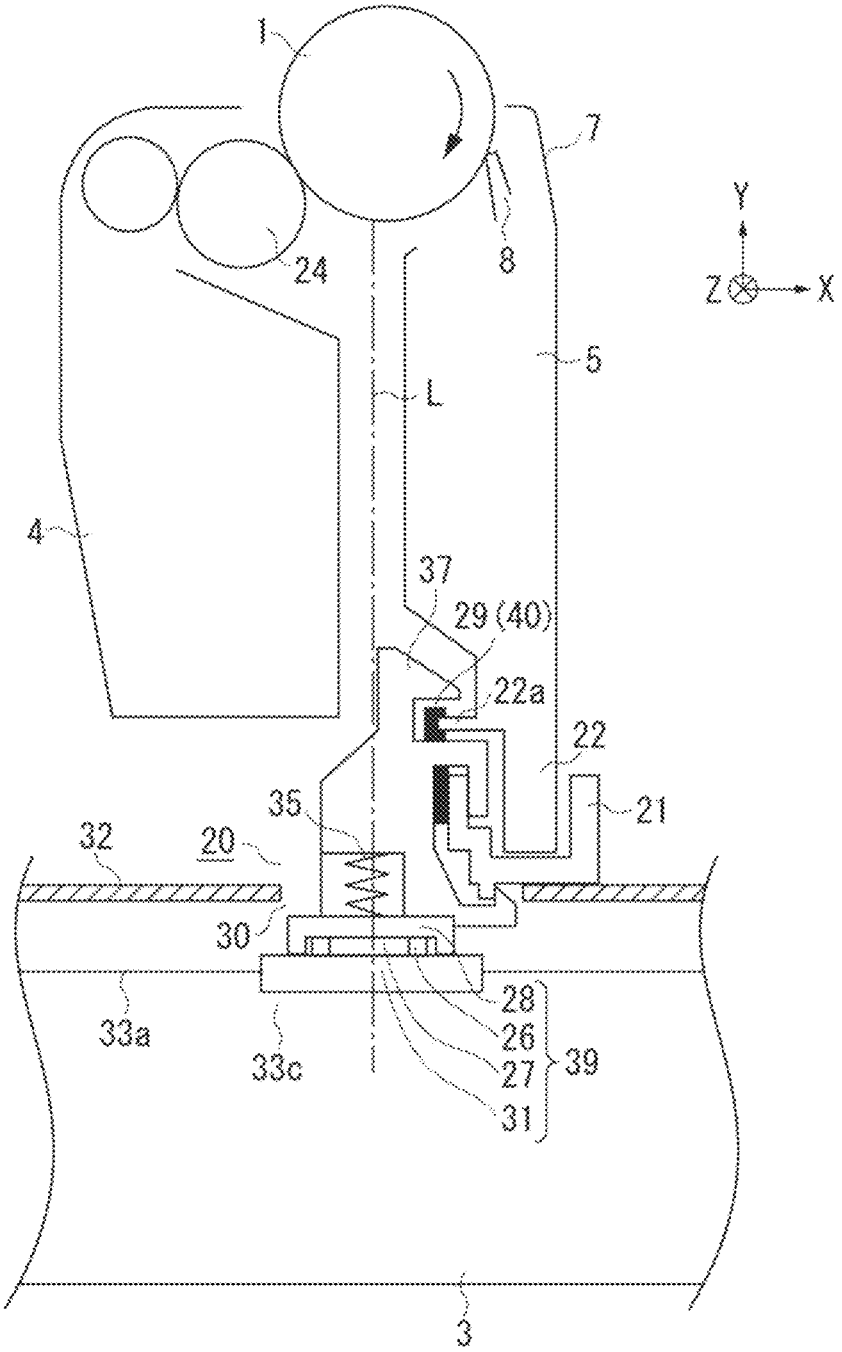
FIG. 2 is a sectional view of a cartridge inserted into the apparatus main body and its vicinity.
Figure 3:
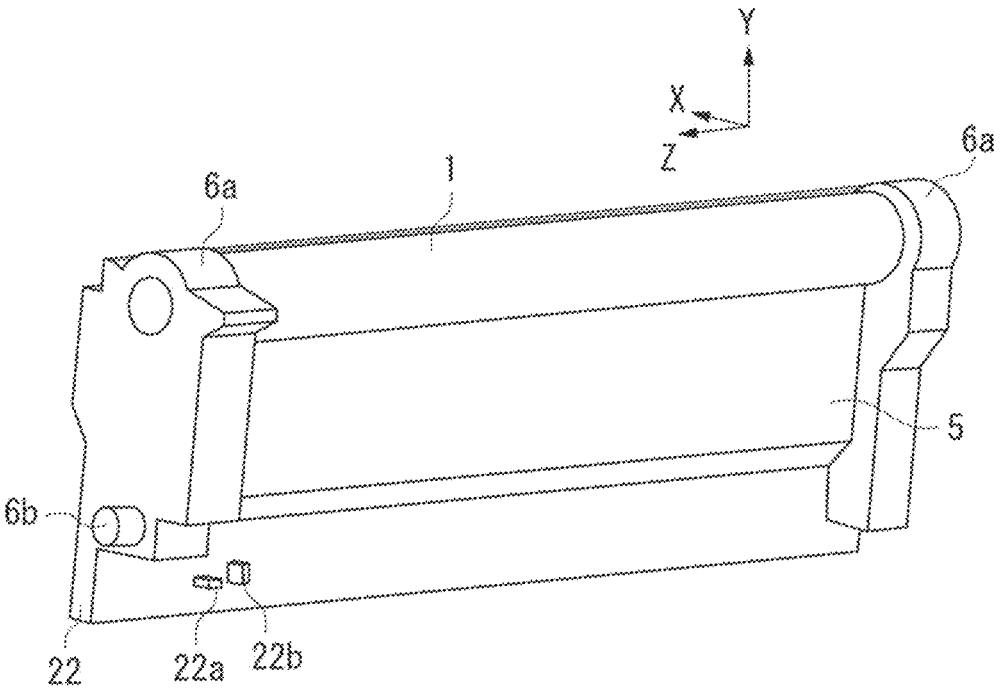
FIG. 3 is a perspective view of the cartridge.

Next, a cleaning mechanism for a cover glass 31 provided in the optical unit 3 will be described. While the following description centers on a cleaning mechanism corresponding to one cartridge 7, similar cleaning mechanisms are provided for the other cartridges 7. FIG. 2 is a sectional view illustrating one cartridge 7 attached to the apparatus main body 100 and its vicinity as seen from the +Z direction. FIG. 3 is a perspective view of the cartridge 7 inserted into the apparatus main body 100. To facilitate the understanding of the description, the developing unit 4 is omitted in FIG. 3.

The optical unit 3 is arranged vertically below the cartridge 7. Laser light L emitted from an opening 33*c* of the casing 33 of the optical unit 3 passes through an opening 30 to be applied to the photosensitive drum 1. The optical unit 3 is equipped with the cover glass 31 as a transmission member closing the opening 33*c* of the casing 33 while allowing the laser light L to be transmitted therethrough. The cover glass 31 prevents foreign matter such as toner and dust including paper dust from entering the casing 33 of the optical unit 3, thereby protecting a mirror, lens, etc. (not illustrated) in the casing 33 of the optical unit 3 from being stained.

The image forming apparatus main body 100 has a stay member 32, which is formed of sheet metal and forms a main body framework serving as a partition between the cartridge 7 and the optical unit 3. At a position opposite the cover glass 31, the stay member 32 is provided with the opening 30 for applying the laser light L having been transmitted through the cover glass 31 of the optical unit 3 to the photosensitive drum 1.

The stay member 32 supports, at a position adjacent to the opening 30, an insertion guide 21 serving as a guide at the time of insertion and extraction of the cartridge 7. When the user inserts the cartridge 7 into the apparatus main body 100, an insertion rib 22 incorporated in the cleaner unit 5 of the cartridge 7 is guided by the insertion guide 21, whereby the cartridge 7 is inserted in the +Z direction (main scanning direction).

The insertion guide 21 is raised and lowered in conjunction with an opening/closing cover opened and closed to attach and detach the cartridge 7. In the following, its construction will be described in detail.

Figure 19A:
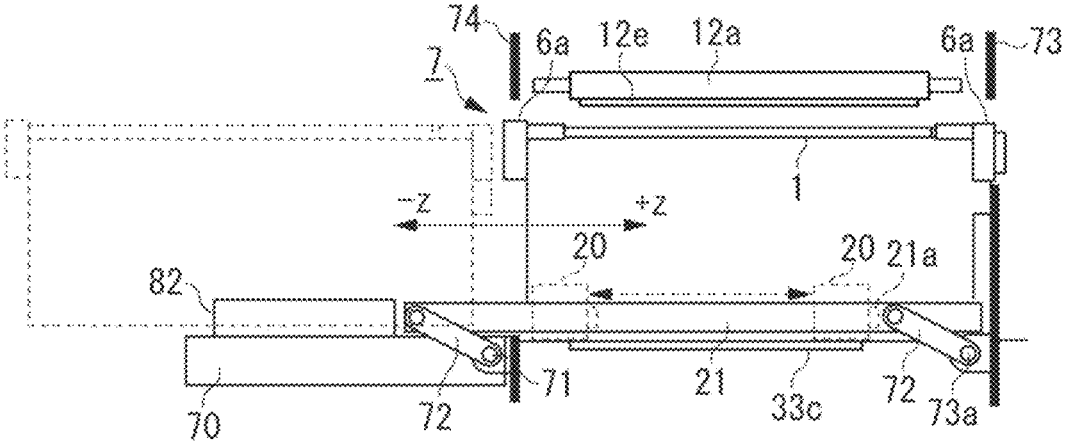
FIG. 19A is a side view illustrating the cartridge inserted into an insertion guide with a front door of the apparatus main body opened.
Figure 19B:
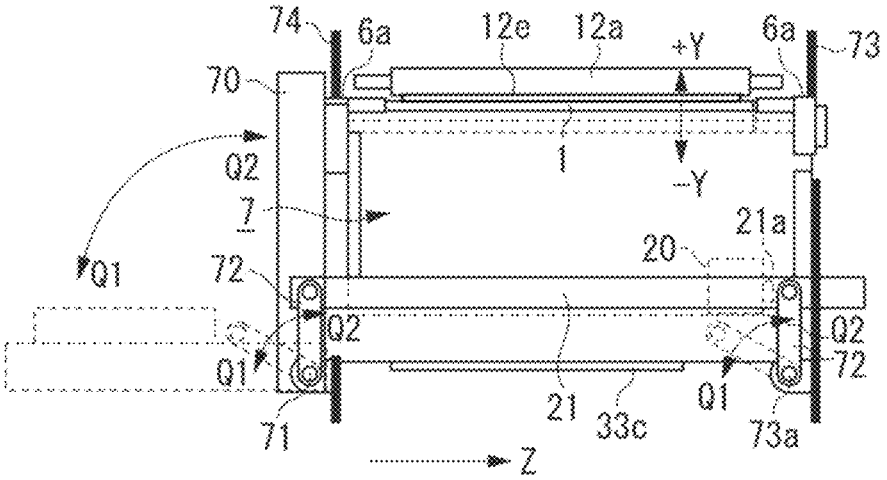
FIG. 19B is a side view of the cartridge set at an image forming position by closing the front door of the apparatus main body.

FIGS. 19A and 19B illustrate the operation performed when attaching and detaching the cartridge 7 to and from the apparatus main body 100. FIG. 19A illustrates the operation performed when slide-attaching and slide-detaching the cartridge 7 to and from the apparatus main body 100, and FIG. 19B illustrates a state in which the cartridge 7 is set at the image forming position through the operation of closing a door 70.

As illustrated in FIG. 19B, when the door 70 is opened around a rotation shaft 71 (rotated in the direction Q1 in FIG. 19B), rotary arms 72 rotate in the direction Q1 in FIG. 19B in conjunction with the rotation of the rotation shaft 71. Rotary arms 72 are provided on the front and rear sides of each of the insertion guides 21. The insertion guide 21, which is rotatably supported by the rotary arms 72, is link-rotated to the position illustrated in FIG. 19A around the rotation shaft 71 and a rotation center 73*a* belonging to a rear side frame 73. As a result, a state of each cartridge 7 in the apparatus main body 100 is changed from a positioning state in which image formation is possible (first state) to a non-positioning state in which the attachment and detachment to and from the apparatus main body 100 is possible (second state). The state of the cartridge 7 is changed from the first state to the second state by lowering of the cartridge 7 in the direction −Y in FIG. 19B. Thus, the cartridge 7 to be replaced is pulled to the front side of the apparatus main body 100 (the direction indicated by an arrow −Z), and is extracted to the exterior of the apparatus main body 100 while causing the insertion rib 22 on the lower portion of the cleaner unit 5 to slide along a guide groove portion 82 of the door 70.

Then, a new cartridge 7 is inserted into the apparatus main body 100 via the opening with the driving side being ahead. The insertion rib 22 on the lower portion of the cleaner unit 5 is caused to slide along the insertion guide 21 to the rear side of the apparatus main body 100 (the direction of an arrow +Z), while being engaged with the guide groove portion 82 of the door 70, and the cartridge 7 is pushed in until the cartridge rear side surface abuts the rear side frame 73. When all the cartridges 7 to be replaced with new ones have been replaced, the door 70 is closed (rotated in the direction Q2 in FIG. 19B). Through this operation of closing the door 70, the rotary arms 72 are rotated in the direction Q2 in FIG. 19B, and a state of each cartridge 7 is changed from the non-positioning state in which the attachment and detachment to and from the apparatus main body 100 is possible (the second state) to the positioning state in which image formation is possible (the first state). The state of the cartridge 7 is changed from the second state to the first state by raising the cartridge 7 in the direction +Y in FIG. 19B.

When the cartridge 7 has been completely inserted into the apparatus main body 100, a portion of the cartridge 7 abuts the inner end of the apparatus main body in the Z direction to fix the position of the cartridge 7 in the Z direction. Further, the cartridge 7 has a bearing portion 6*a* (FIG. 3) coaxially arranged with the rotation axis of the photosensitive drum 1.

The circumferential surface of the bearing portion 6*a* abuts a V-shaped groove (not illustrated) of the apparatus main body 100 to fix the position in the X and Y directions. A boss 6*b* of the cartridge 7 is fit-engaged with an elongated hole (not illustrated) on the rear side of the apparatus main body 100, thereby preventing the cartridge 7 from rotating around the Z-axis.

Further, a cartridge pressing mechanism (not illustrated) is installed on the rail surface of the insertion guide 21. This cartridge pressing mechanism is composed of a cartridge pressing spring (not illustrated) and a pressing follower (not illustrated) installed on the rail surface. After the cartridge 7 has been raised to the first state and the position thereof is fixed in the X and Y direction to the front side frame and the rear side frame, solely the insertion guide 21 is further raised, and a pressing force is applied to the positioning portions of a front side frame 74 and the rear side frame 73 of the cartridge 7 by the urging force of the cartridge pressing spring.

A cleaning unit 20 is supported by the insertion guide 21 so as to be movable in the ±Z directions. By the insertion and extraction of the cartridge 7, the cleaning unit 20 moves in the +Z direction (first direction) or in the −Z direction (second direction) to clean the cover glass 31. Cleaning members 26 and 27 (cleaning sheet 26 and wiping member 27) of the cleaning unit 20 are pressed downwards (in the −Y direction) by a spring 35 to be held in contact with the surface of the cover glass 31 to perform cleaning thereon. The insertion rib 22 of the cartridge 7 is equipped with an engagement portion 22*a* serving as a first contact portion, the engagement portion 22*a* being configured to be engaged with the cleaning unit 20 and capable of pressing, and an auxiliary engagement portion 22*b* serving as a second contact portion (See FIG. 3). The auxiliary engagement portion 22*b* is provided on the upstream side in the +Z direction of the engagement portion 22*a*.

Figure 20:
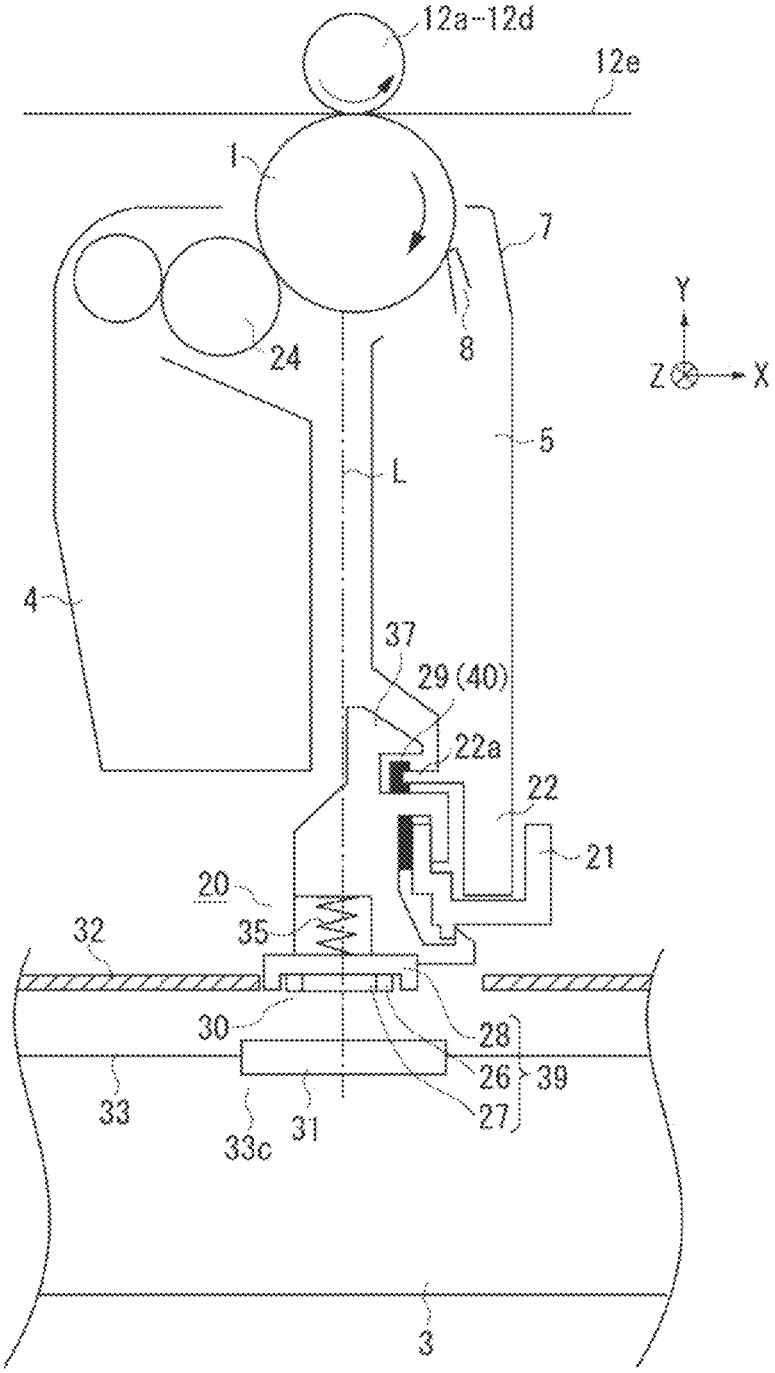
FIG. 20 is a sectional view of the cartridge attached to the apparatus main body and its vicinity.

FIG. 20 is a sectional view illustrating the positioning state in which image formation is possible (the first state). When the insertion guide 21 is raised as illustrated in FIG. 20, the cleaning unit 20 is separated from the surface of the cover glass 31, and moves to a position above the lower surface of the stay member 32. This helps to prevent the vibration which the cartridge 7 receives from a drive portion (not illustrated) at the time of image formation from being directly transmitted to the optical unit 3. Further, in the present exemplary embodiment, the optical unit 3 is attached in the +X direction illustrated in FIG. 20, and at the time of service replacement, etc., the operation of replacing the optical unit 3 is performed with the insertion guide 21 raised, whereby damage of the cleaning unit 20 is prevented. Further, in the ordinary installation state of the apparatus, the insertion guide 21 is in the first state, and the cleaning member 26 and the wiping member 27 described below are not constantly held in the contact state. Thus, the cleaning sheet 26 and the wiping member 27 are not subject to deformation when left to stand, making it possible to maintain the cleaning capacity thereof with the passage of time. Further, when the apparatus is in the transportation process, vibration and shock of the apparatus are not transmitted to the cover glass 31, so that it is possible to achieve a satisfactory maintenance capacity for the cover glass 31 and the cleaning members.

[Cleaning Unit 20]

Figure 4A:
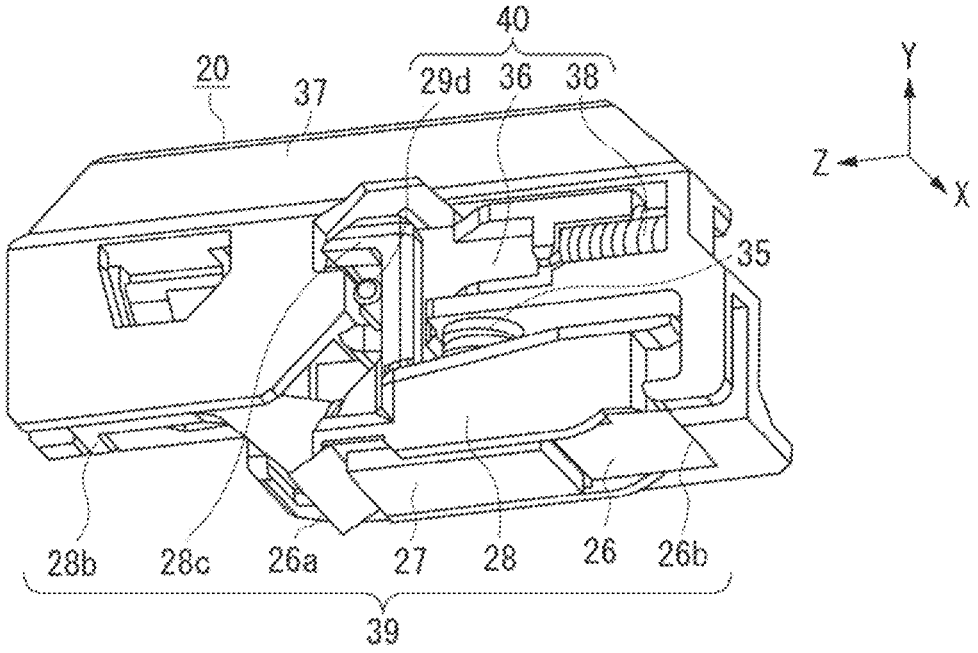
FIGS. 4A and 4B are perspective views of a cleaning unit.
Figure 4B:
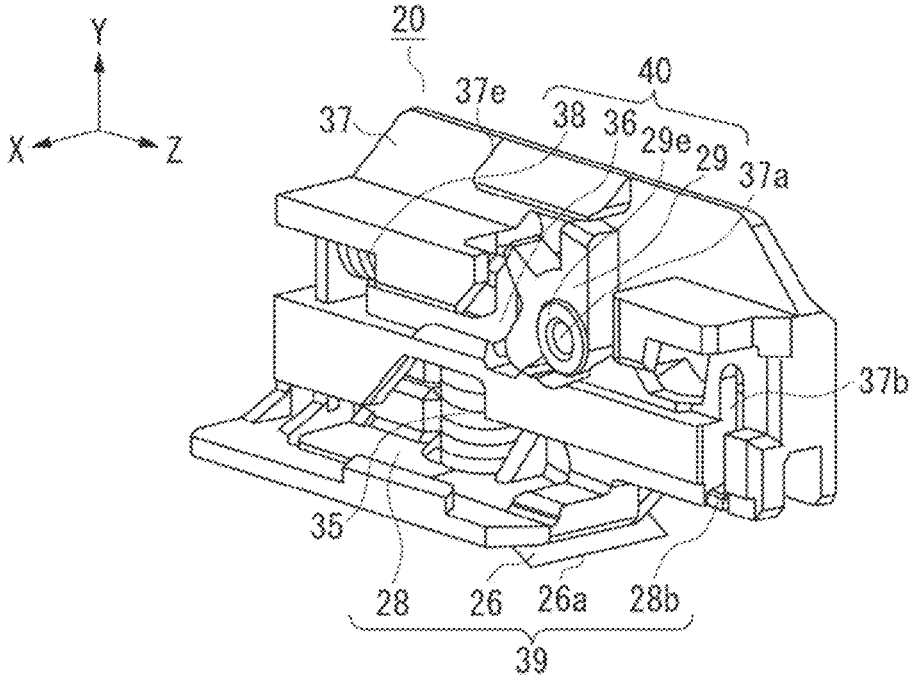

Next, the construction of the cleaning unit 20 will be described in detail. FIGS. 4A and 4B are perspective views of the cleaning unit 20 constituting the cleaning mechanism.

The cleaning unit 20 is equipped with a slide member (moving member) 37 supported by the insertion guide 21 so as to be movable in the ±Z directions, a swinging member 39 supported by the slide member 37 so as to be swingable around the X-axis, a switching unit 40 configured to swing the swinging member 39, and the spring 35. The swinging member 39 is equipped with the cleaning members 26 and 27 configured to perform cleaning while in contact with the cover glass 31. The spring 35 is provided between the slide member 37 and the swinging member 39, and presses the swinging member 39 downwards (in the −Y direction).

Figure 5A:
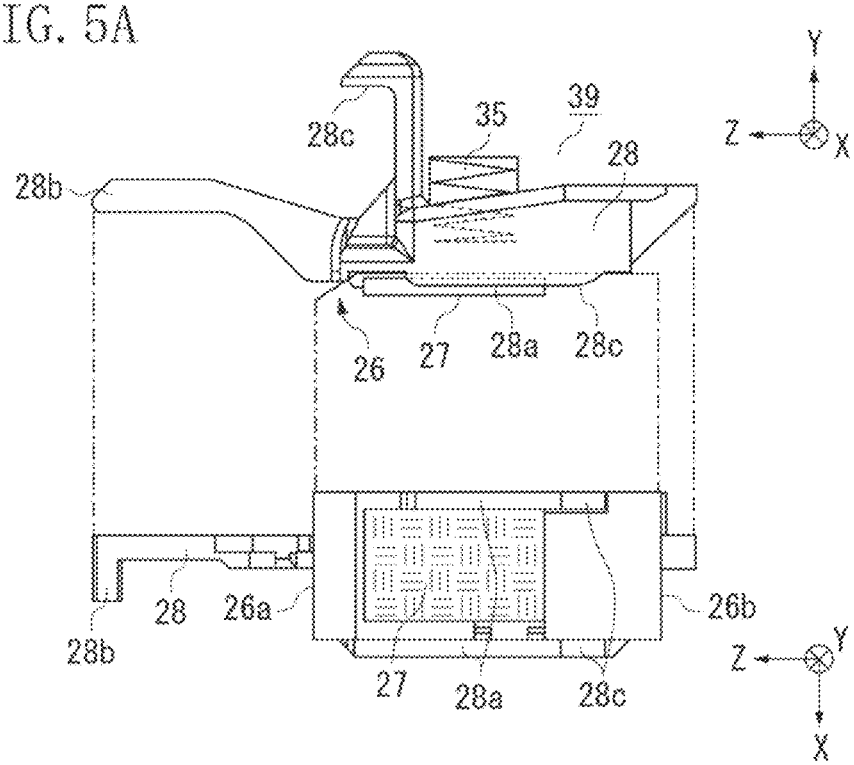
FIG. 5A is a side view and a bottom view of a swinging member.

Next, the swinging member 39 will be described in detail. FIG. 5A is a side view (upper side) and a bottom view (lower side) of the swinging member 39. The swinging member 39 is equipped with a base member 28, the flexible cleaning sheet 26 fixed to the bottom surface of the base member 28, and the wiping member 27 superimposed on and attached to the cleaning sheet 26.

The cleaning sheet 26 is formed by bending a film-like sheet member, and both ends in the Z direction thereof constitute a leading edge portion 26*a* and a leading edge portion 26*b* (a first cleaning portion 26*a* and a second cleaning portion 26*b*). Depending upon the position of the swinging member 39 rotating around the X-axis, one of the leading edge portion 26*a* and the leading edge portion 26*b* comes into contact with the cover glass 31, and the leading edge portion 26*a* and the leading edge portion 26*b* are not simultaneously held in contact with the cover glass 31. Each of the leading edge portions 26*a* and 26*b* is held in contact with the cover glass 31 at an angle such that a vector indicating the direction from the center (root) toward the leading edge portion along the sheet surface and a vector indicting the moving direction of the cover glass 31 as seen from the leading edge portion when performing cleaning while held in contact with the cover glass 31 respectively have vector components opposite each other. That is, when performing cleaning while held in contact with the cover glass 31, each of the leading edge portions 26*a* and 26*b* comes into contact with the cover glass 31 in a counter direction with respect to the advancing direction, scraping off (sweeping) foreign matter on the cover glass 31. On the other hand, the wiping member 27 is formed of polyester non-woven cloth (fiber-like material), and is configured to collect foreign matter on the cover glass 31 by the movement of the cleaning unit 20.

Abutment surfaces 28*a* and 28*d* are provided at both ends in the X direction of the wiping member 27 on the bottom surface of the base member 28. Depending upon the position of the swinging member 39 rotating around the X-axis, one of the abutment surfaces 28*a* and 28*d* abuts the cover glass 31, regulating the positions in the Y direction of the cleaning sheet 26 and the wiping member 27. By causing the abutment surfaces 28*a* or 28*d* to abut the cover glass 31, the leading edge portions 26*a* and 26*b* of the cleaning sheet 26 are reliably brought into contact with the surface of the cover glass 31 in a deflected state, making it possible to bring the wiping member 27 into press contact with the surface of the cover glass 31 in a state in which it is crushed in the thickness direction (the Y direction).

Provided at the leading edge of the base member 28 is a base arm 28*b* configured to be slidably fit-engaged with a longitudinal groove portion 37*b* (See FIG. 4B) elongated in the Y direction of a slide member 37 and configured to come into contact with the slide member 37 in the ±Z directions. Further, on the upper portion of the base member 28, there is provided a pressed portion 28*c* configured to be pressed by the switching unit 40. When the pressed portion 28*c* is pressed, the base member 28 swings with respect to the slide member 37 with the base arm 28*b* being fit-engaged with the longitudinal groove portion 37*b*.

Figure 5B:
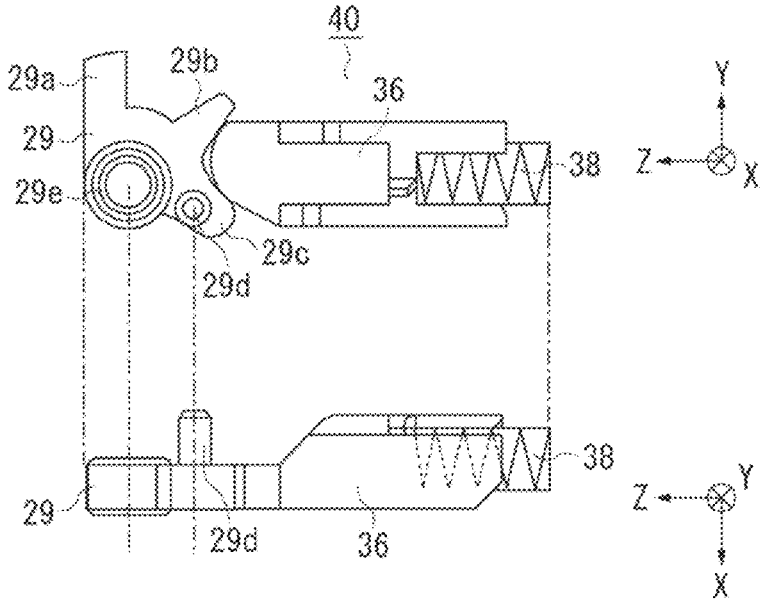
FIG. 5B is a side view and a bottom view of a switching unit.

Next, the switching unit 40 will be described in detail. FIG. 5B is a side view (upper side) and a bottom view (lower side) of the switching unit 40. A cam lever 29 has a bearing portion 29*e* into which a rotation shaft 37*a* (See FIG. 4B) of the slide member 37 is inserted, and is rotatably retained with respect to the slide member 37. Further, a slide cam 36 is also retained by the slide member 37 so as to be slidable in the ±Z directions with respect to the slide member 37, and is pressed in the +Z direction by a spring 38 (cam spring 38) to abut the cam lever 29. The cam lever 29 has a first lever portion 29*a*, a second lever portion 29*b*, and a cam follower portion 29*c*. The cam follower portion 29*c* is provided with a cam boss 29*d* protruding in the −X direction. The cam boss 29*d* is provided so as to be capable of coming into contact with the pressed portion 28*c* of the swinging member 39, causing the swinging portion 39 to swing to switch its position in the cleaning unit 20.

[Operation of Cleaning the Cover Glass 31]

Figure 9A:
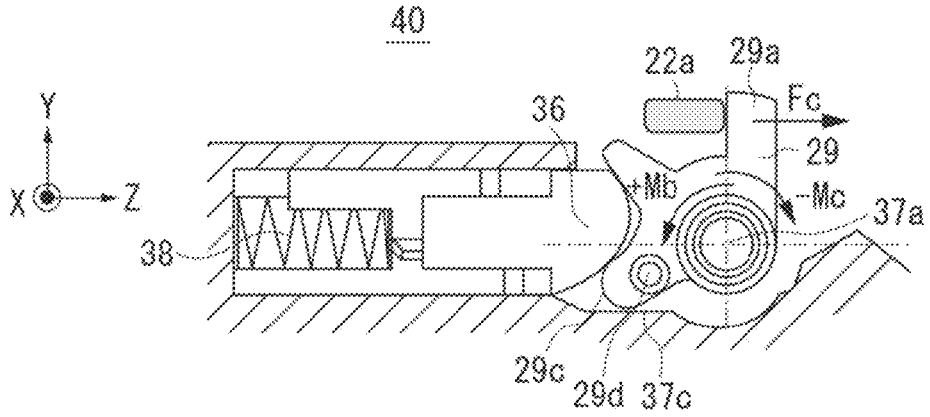
FIGS. 9A, 9B, and 9C are enlarged views of the switching unit.
Figure 9B:
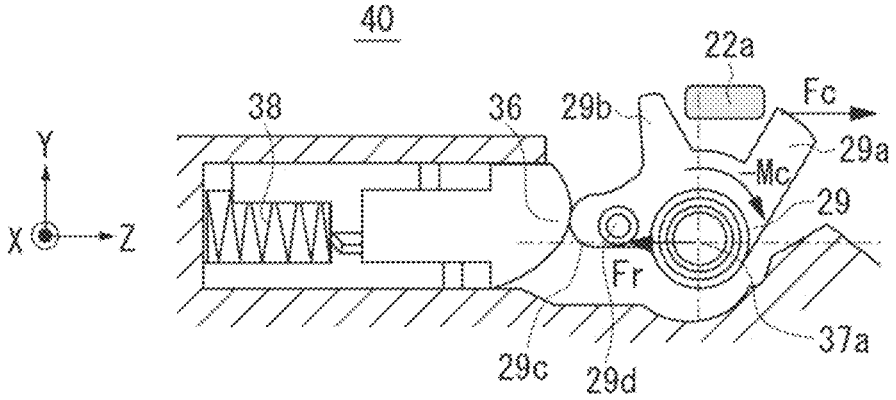
Figure 9C:
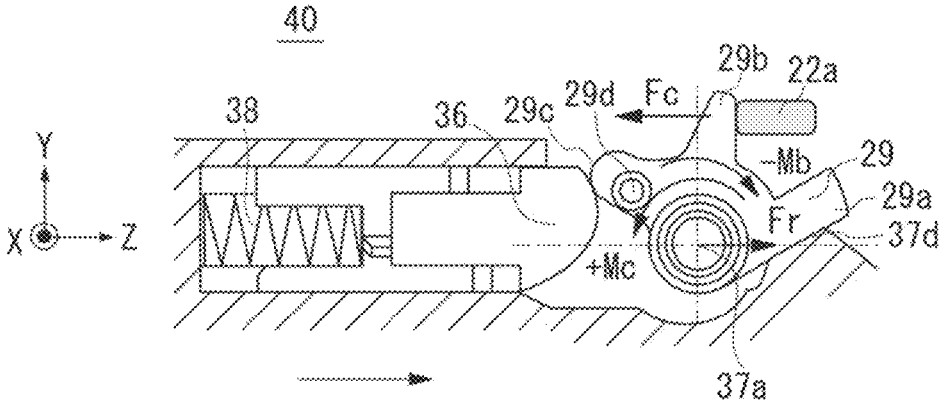
Figure 10A:
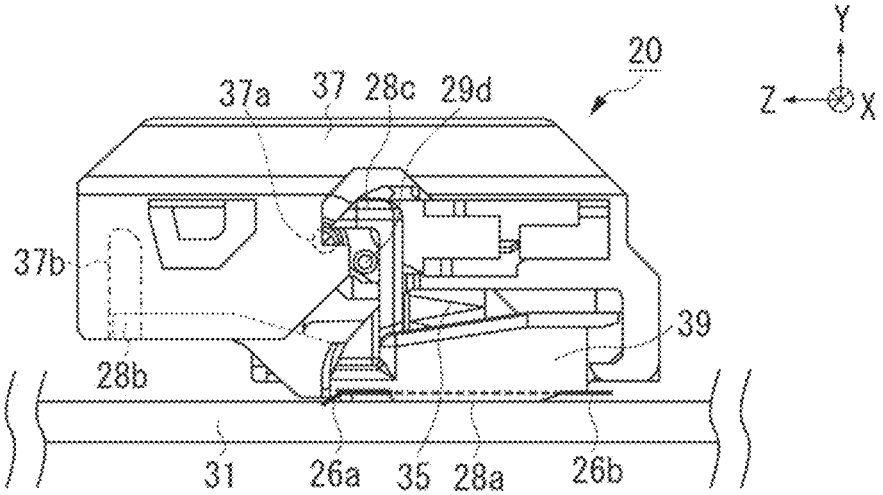
FIGS. 10A and 10B are diagrams illustrating a cleaning unit as seen from the +X direction.
Figure 10B:
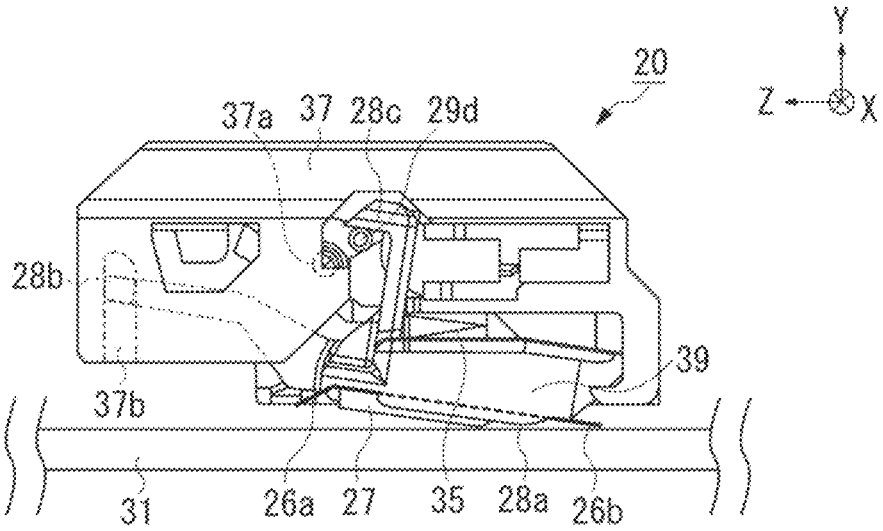

Next, the operation of cleaning the cover glass 31 will be described. FIGS. 6A, 6B, 7A, 7B, 8A, and 8B are diagrams illustrating the cleaning mechanism of the apparatus main body as seen from the −X direction. FIGS. 9A through 9C are enlarged views of the switching unit 40. FIGS. 10A and 10B are diagrams illustrating the cleaning unit 20 as seen from the +X direction. The cleaning unit 20 moves in conjunction with the insertion and extraction of the cartridge 7, which serves as the insertion/extraction member to be inserted or extracted into or from the apparatus main body 100. In the following, for the sake of convenience, the movement path of the cleaning unit 20 when the cartridge 7 is inserted into the apparatus main body 100 will be referred to as a forward way, and the movement path when the cartridge is pulled out of the apparatus main body 100 will be referred to as a backward way.

[Operation when the Cartridge 7 is Inserted]

Figure 6A:
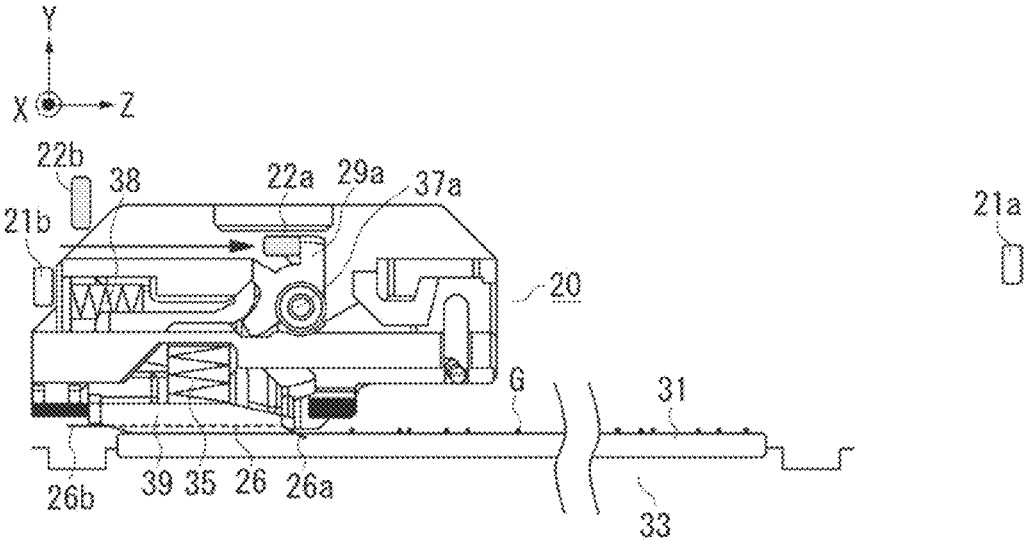
FIGS. 6A and 6B are diagrams illustrating a cleaning mechanism as seen from the −X direction.

The cleaning operation by the cleaning unit 20 on the forward way, i.e., the operation when the cartridge 7 is inserted into the apparatus main body 100 in the state in which no cartridge 7 is attached to the apparatus main body 100, will be described. FIG. 6A illustrates the state before the attachment of the cartridge 7 to the apparatus main body 100, i.e., the state in which the cleaning unit 20 is kept on standby at the home position. Foreign matter G such as toner and dust including paper dust adheres to the surface of the cover glass 31. In this state, the first cleaning portion 26*a* of the cleaning sheet 26 and the wiping member 27 are held in contact with the cover glass 31, and the second cleaning portion 26*b* of the cleaning sheet 26 is spaced away from the cover glass 31. When the cartridge 7 is inserted into the apparatus main body 100 in the Z direction to attach it thereto, the engagement portion 22*a* abuts and is engaged with the first lever portion 29*a* of the cam lever 29.

Figure 6B:
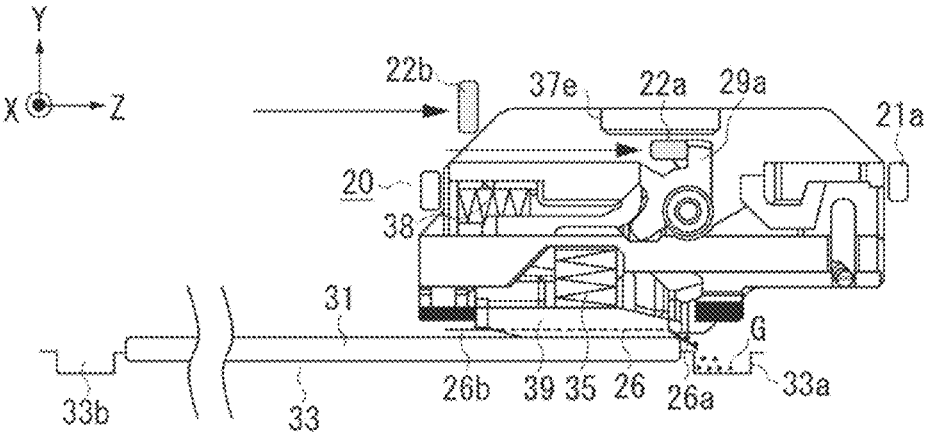

Next, as illustrated in FIG. 6B, when the cartridge 7 is further pushed in after the engagement portion 22*a* has reached the first lever portion 29*a*, since the rotation of the cam lever 29 is restricted by the pressing force of the spring 38, the cleaning unit 20 is pressed by the engagement portion 22*a* of the cartridge 7 to move in the +Z direction (the first direction).

Here, the movement of the cleaning unit 20 will be described. As illustrated in FIG. 9A, when the engagement portion 22*a* is kept on standby, the cam lever 29 is being pressed in the +Z direction by the cam spring 38 via the slide cam 36. Thus, a rotational moment +Mb around the rotation shaft 37*a* acts on the cam follower portion 29*c* of the cam lever 29. Symbol "+" indicates a counterclockwise direction in FIGS. 9A, 9B, and 9C. At the same time, the cam follower portion 29*c* abuts a first abutment portion 37*c* of the slide member 37 to fix the rotational phase of the cam lever 29. The engagement rib 22*a* presses the first lever portion 29*a* of the cam lever 29 in the +Z direction, whereby the cam lever 29 receives a rotational moment −Mc around the rotation shaft 37*a*. The magnitude of the rotational moment −Mc is determined by the relationship between a pressing force Fc in the +Z direction exerted by the engagement portion 22*a* and a resistance force Fr of the movement in the −Z direction exerted by the slide member 37 (the rotation shaft 37*a*). Until the cleaning unit 20 abuts a stopper 21*a* (See FIG. 6A) provided on the downstream side in the +Z direction of the insertion guide 21, since the resistance force Fr consists of a minute slide friction resistance force between the cleaning member 39 and the cover glass 31, and a minute slide load resistance force between the slide member 37 and the insertion guide 21, the rotational moment −Mc is relatively small. Thus, $|Mb|>|Mc|$, and the cam lever 29 does not rotate clockwise against the force of the spring 38, and the cleaning unit 20 moves in the +Z direction upon receiving a force from the engagement portion 22*a* while maintaining the phase state of FIG. 9A.

While the cleaning unit 20 is moving in the +Z direction, the first cleaning portion 26*a* of the cleaning sheet 26 scrapes off the foreign matter G on the cover glass 31 and causes it to move downstream in the +Z direction. The foreign matter G that has not been scraped off by the first cleaning portion 26*a* is collected by the wiping member 27. Due to the shock when it passes a step portion at the downstream side end portion in the +Z direction of the cover glass 31 and due to its own weight, the first cleaning portion 26*a* moves the foreign matter G that it has scraped off to a groove-shaped collecting portion 33*a* provided in the upper portion of the casing 33 of the optical unit 3 and stores it therein. After this, the cleaning unit 20 abuts the stopper 21*a* provided on the downstream side in the +Z direction of the insertion guide 21 and stops there. In this state, the position of the cartridge 7 with respect to the apparatus main body 100 has not been determined yet.

Figure 7A:
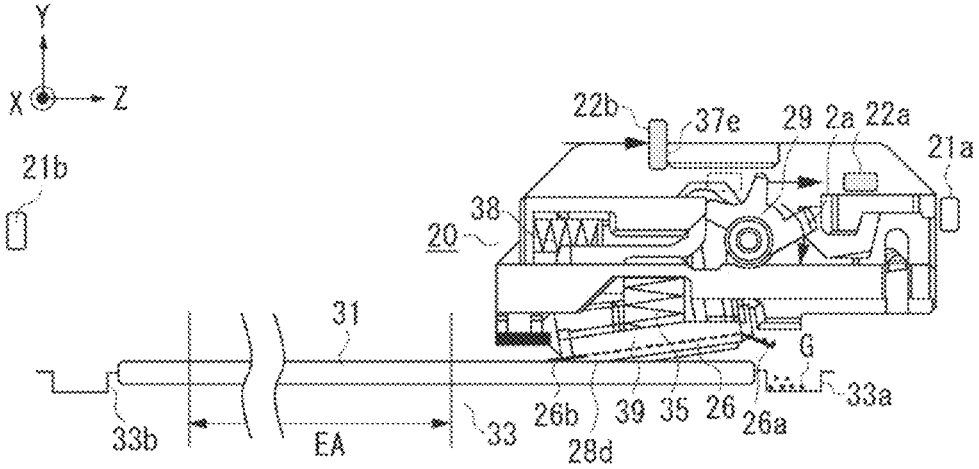
FIGS. 7A and 7B are diagrams illustrating the cleaning mechanism as seen from the −X direction.

When the cartridge 7 is further moved in the +Z direction, and is inserted to a position where it is set in position with respect to the image forming apparatus main body 100, the engagement portion 22*a* rotates the cam lever 29 clockwise as illustrated in FIG. 7A. That is, since the slide member 37 abuts the stopper 21*a*, the resistance force that the stopper 21*a* exerts to the slide member 37 is added to the resistance force Fr of the movement in the −Z direction exerted by the slide member 37 (the rotation shaft 37*a*). Thus, as illustrated in FIG. 9B, by the operational force of the user, it is possible to cause the pressing force Fc which is exerted by the engagement portion 22*a* to act on the cam lever 29 such that the relationship of the rotational moment around the rotation shaft 37*a* is as follows: $|Mb|<|Mc|$. Thus, when the user further pushes in the cartridge 7 in the +Z direction, it is possible to push away the slide cam 36 in the −Z direction against the pressing force of the cam spring 38 and to rotate the cam lever 29 clockwise.

When the cam follower portion 29*c* of the cam lever 29 rotates clockwise until it gets over the apex of the cam surface of the slide cam 36, the cam lever 29 further rotates clockwise due to the pressing force of the cam spring 38 transmitted via the slide cam 36. And, as illustrated in FIG. 9C, the first lever portion 29*a* abuts a second abutment portion 37*d* of the slide member 37, and the cam lever 29 is retained.

At this time, the cleaning unit 20 is situated outside an exposure range EA at the time of image formation. Further, due to the clockwise rotation of the cam lever 29, the first cleaning portion 26*a* of the cleaning sheet 26 moves upwards to a position where it is not in contact with the cover glass 31, and the second cleaning portion 26*b* comes into contact with the cover glass 31.

The swinging of the swinging member 39 at the time of the rotation of the cam lever 29 will be described in detail. Before the cam lever 29 rotates (i.e., when the cam lever 29 is in the state in which the cam follower portion 29*c* abuts the first abutment portion 37*c*), the swinging member 39 is at a first position as illustrated in FIG. 10A, and the first cleaning portion 26*a* of the cleaning sheet 26 comes into contact with the cover glass 31 in a deflected state. Further, the wiping member 27 is also held in press contact with the cover glass 31. On the other hand, the second cleaning portion 26*b* of the cleaning sheet 26 is retracted to a position upwardly spaced away from the cover glass 31. At this time, the abutment surface 28*a* of the base member 28 is held in contact with the cover glass 31.

Then, the cam lever 29 rotates, whereby, as illustrated in FIG. 10B, the cam boss 29*d* of the cam lever 29 upwardly presses the pressed portion 28*c* of the base member 28, and the base member 28 is placed in a state in which it is inclined with respect to the cover glass 31. That is, the position of the swinging member 39 with respect to the slide member 37 has been changed from the first position to a second position. At this time, the abutment surface 28*d* of the base member 28 comes into contact with the cover glass 31, and the second cleaning portion 26*b* of the cleaning sheet 26 comes into contact with the cover glass 31 in a deflected state. On the other hand, the first cleaning portion 26*a* is retracted to a position upwardly spaced away from the cover glass 31. Further, substantially the entire region of the wiping member 27 is retracted from the cover glass 31, and solely the upstream end portion in the +Z direction thereof is in contact with the cover glass 31.

In the state in which the cartridge 7 has been completely inserted in the +Z direction, the auxiliary engagement portion 22*b* of the cartridge 7 moves to a position where it is in close proximity to a protrusion rib end portion 37*e* of the slide member 37. The role of the auxiliary engagement portion 22*b* will be described in detail below.

[Operation when the Cartridge 7 is Extracted]

Next, to be described will be the cleaning operation by the cleaning unit 20 on the backward way when the cartridge 7 attached to the apparatus main body 100 is pulled out of the apparatus main body 100 to be detached from the apparatus main body 100.

Figure 7B:
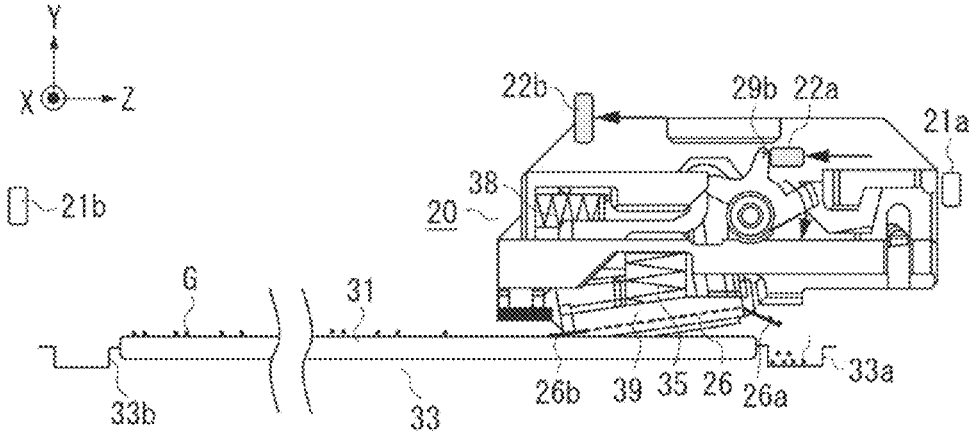

As illustrated in FIG. 7B, when the cartridge 7 is pulled out, the engagement portion 22*a* abuts the second lever portion 29*b* of the cam lever 29 to press it in the −Z direction. At this time, as illustrated in FIG. 9C, the cam follower portion 29*c* is pressed in the +Z direction by the cam spring 38 via the slide cam 36, so that a rotational moment −Mb around the rotation shaft 37*a* is imparted thereto. On the other hand, the second lever portion 29*b* is pressed in the −Z direction by the engagement portion 22*a* with the pressing force Fc. However, until the cleaning unit 20 abuts the stopper 21*b* (See FIG. 7B) provided on the upstream side in the +Z direction of the insertion guide 21, the resistance force Fr against the movement in the +Z direction exerted by the slide member 37 (the rotation shaft 37*a*) consists of the minute slide friction resistance force between the cleaning member 39 and the cover glass 31, and the minute slide load resistance force between the slide member 37 and the insertion guide 21. That is, the rotational moment +Mc is relatively small. Thus, $|Mb|>|Mc|$, so that, upon receiving the force in the −Z direction from the engagement portion 22*a*, the cam lever 29 does not rotate, and the cleaning unit 20 moves in the −Z direction (the second direction).

While the cleaning unit 20 is moving in the −Z direction, the second cleaning portion 26*b* scrapes off the foreign matter G accumulated on the cover glass 31 and moves it in the −Z direction. On the other hand, substantially the entire region of the wiping member 27 is retracted from the cover glass 31. This is due to the fact that even in a case where there exists the foreign matter G that cannot be scraped off and moved by the second cleaning portion 26*b* on the backward way, that foreign matter G can be scraped off and moved by the first cleaning portion 26*a* on the forward way when the cartridge 7 is inserted again. That is, what is most important is that there is no foreign matter G on the cover glass 31 at the time of image formation. Thus, when inserting the cartridge 7 into the apparatus main body 100 again in order to perform image formation, solely the foreign matter G that could not be removed through the cleaning by the first cleaning portion 26*a* is eventually collected by the wiping member 27. As a result, it is possible to suppress the amount of the foreign matter G collected by the wiping member 27 and to extend the time until the collecting amount of the wiping member 27 reaches the upper limit to thereby achieve an increase in service life while reliably cleaning the cover glass 31 through the final operation (the insertion of the cartridge 7) before the image formation. Further, there is no fear of the wiping member 27 and the cover glass 31 rubbing each other more than necessary, so that it is possible to suppress the damage of the wiping member 27, thus increasing its service life.

Figure 8A:
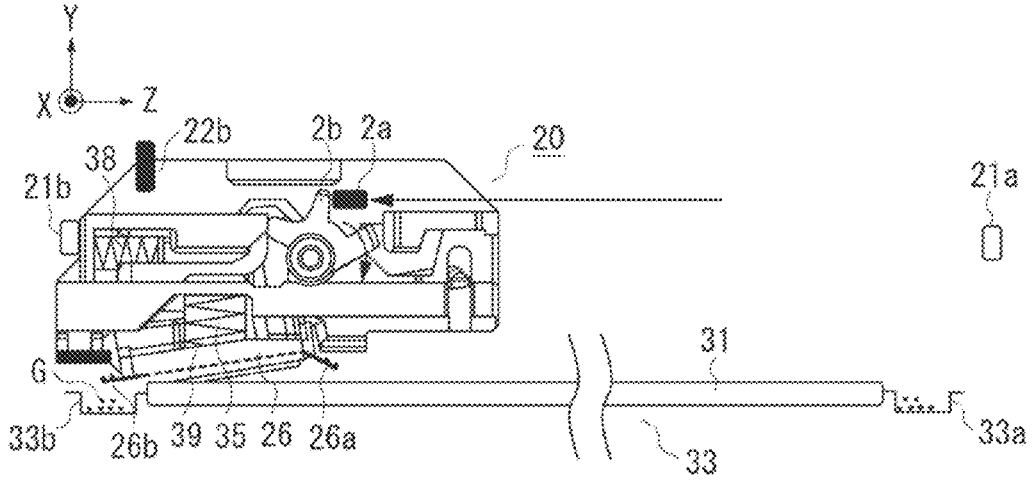
FIGS. 8A and 8B are diagrams illustrating the cleaning mechanism as seen from the −X direction.

As illustrated in FIG. 8A, a collecting portion 33*b* is provided on the upstream side in the +Z direction of the cover glass 31 in the upper portion of the casing 33 of the optical unit 3, and it is possible to drop and store the foreign matter G scraped off and moved in the −Z direction by the second cleaning portion 26*b*. After this, the cleaning unit 20 abuts the stopper 21*b* provided on the upstream side in the +Z direction of the insertion guide 21 and stops there.

Figure 8B:
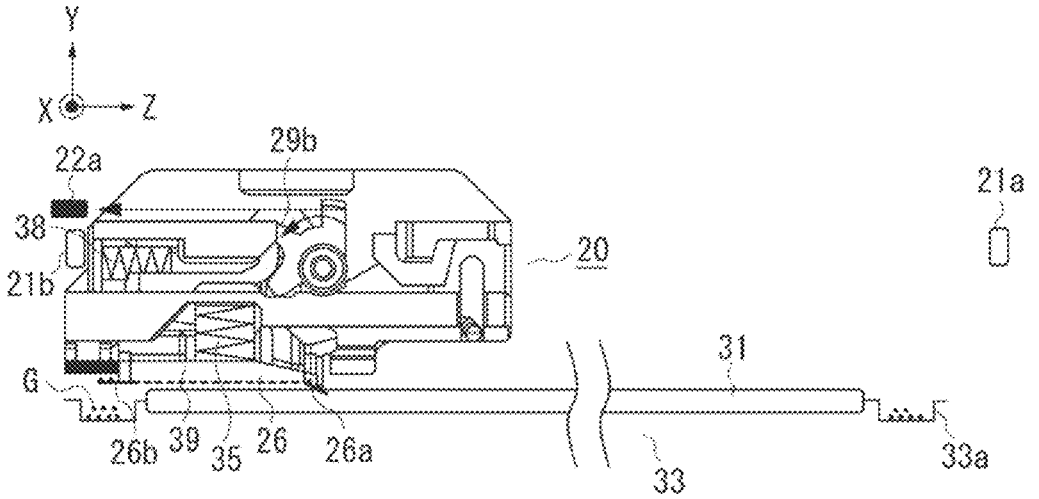

When, from here, the cartridge 7 is completely pulled out, the engagement portion 22*a* rotates the cam lever 29 counterclockwise as illustrated in FIG. 8B. That is, since the slide member 37 abuts the stopper 21*b*, the resistance force the stopper 21*b* exerts to the slide member 37 is added to the resistance force Fr of the movement in the +Z direction exerted by the slide member 37 (the rotation shaft 37*a*). Thus, as illustrated in FIG. 9C, by the operational force of the user, it is possible to cause the pressing force Fc which is exerted by the engagement portion 22*a* to act on the cam lever 29 such that the rotational moment around the rotation shaft 37*a* is in the following relationship: $|Mb|<|Mc|$. Thus, when the user pushes in the cartridge 7 further in the +Z direction, it is possible to push away the slide cam 36 in the −Z direction against the pressing force of the cam spring 38 and to rotate the cam lever 29 clockwise.

When the cam follower portion 29*c* of the cam lever 29 rotates counterclockwise until it gets over the apex of the cam surface of the slide cam 36, the cam lever 29 further rotates counterclockwise due to the pressing force of the cam spring 38 transmitted via the slide cam 36. And, as illustrated in FIG. 9A, the cam follower portion 29*c* abuts the first abutment portion 37*c* of the slide member 37, and the cam lever 29 is retained. As a result, the upward pressing of the pressed portion 28*c* of the base member 28 by the cam boss 29*d* is released, and the cleaning member 39 returns to the first position. And, the first cleaning portion 26*a* of the cleaning sheet 26 is brought into contact with the cover glass 31, and the second cleaning portion 26*b* is moved upwards to be retracted to a position spaced away from the cover glass 31.

[Operation when the Cartridge 7 is Inserted Halfway Through the Extraction]

Next, the operation when the user inserts the cartridge 7 halfway through the extraction will be described. More specifically, from the state in which the attachment of the cartridge 7 to the apparatus main body 100 has been completed, as illustrated in FIG. 7A, the cartridge 7 is extracted from the apparatus main body 100 as illustrated in FIG. 7B. In this case, before it has been completely extracted, the cartridge 7 is inserted to the attachment completion position illustrated in FIG. 7A again. As illustrated in FIG. 7B, while the cartridge 7 is being pulled out of the apparatus main body 100, the engagement portion 22*a* is on the downstream side in the +Z direction of the second lever portion 29*b*. Thus, even if the cartridge 7 is moved in the +Z direction at this time, the engagement portion 22*a* cannot press the cleaning unit 20 (the cam lever 29) in the +Z direction. Thus, the cleaning unit 20 stops within the exposure region EA (See FIG. 7A), and hinders the application of the laser light L to the photosensitive drum 1 from the optical unit 3, thus making it impossible to perform normal image formation.

In view of this, the cartridge 7 is provided with the auxiliary engagement portion 22*b* in addition to the engagement portion 22*a*. The auxiliary engagement portion 22*b* is provided on the upstream side in the +Z direction of the engagement portion 22*a*. Thus, as illustrated in FIG. 7B, even if the cartridge 7 is moved in the +Z direction halfway through the extraction of the cartridge 7 from the apparatus main body 100, the auxiliary engagement portion 22*b* presses the protrusion rib end portion 37*e* of the slide member 37 in the +Z direction, making it possible to move the cleaning unit 20 to the exterior of the exposure region EA.

Further, in particular, in the case of shipment with the cartridge 7 attached to the apparatus main body 100, the auxiliary engagement portion 22*b* prevents the cleaning unit 20 from being allowed to move into the exposure region EA due to vibration or shock.

While in the above-described exemplary embodiment, the cleaning unit 20 moves through the insertion and extraction of the cartridge 7, this should not be construed restrictively. That is, it is also possible for the cleaning unit 20 to move in conjunction with the opening and closing of an opening/closing member (not illustrated) or the attachment and detachment of the feeding cassette 11, etc. Alternatively, the cleaning unit 20 may be moved by a user or a serviceman with a dedicated tool. Further, it is also possible to provide within the apparatus main body 100 an actuator such as a dedicated motor configured to move the cleaning unit 20, moving the cleaning unit 20 by the actuator.

Further, while in the above exemplary embodiment, the first and second cleaning portions 26*a* and 26*b* are selectively brought into contact with the cover glass 31 through the swinging of the swinging member 39 equipped with the first and second cleaning portions 26*a* and 26*b*, this should not be construed restrictively. For example, it is possible to provide the first cleaning portion 26*a* on a first retaining member, and to provide the second cleaning portion 26*b* on a second retaining member, with one of the first retaining member and the second retaining member bringing the first and second cleaning portions 26*a* and 26*b* into contact with the cover glass 31 selectively on the forward and backward way.

While in the above example, the first cleaning portion 26*a* and the second cleaning portion 26*b* are formed by the single cleaning sheet 26, this should not be construed restrictively. That is, it is only necessary for the first cleaning portion 26*a* and the second cleaning portion 26*b* to be at least cleaning portions configured to scrape off and move the foreign matter G on the cover glass 31. They may be formed as separate cleaning members, or formed of another material or in another configuration, using rubber blades, brushes, etc.

Further, it is also possible for the first cleaning portion 26*a* and the second cleaning portion 26*b* to be based upon a cleaning concept other than that of "scraping off and moving the foreign matter G on the cover glass 31." That is, it is also possible for them to be based on the cleaning concept of "collecting foreign matter on the cover glass 31." This proves effective, in particular, when the collecting capacity of the cleaning portions exhibits directivity. The collecting capacity exhibits directivity when, for example, the collecting capacity is higher during movement in the first direction than that during movement in the second direction due to the fiber direction, etc. of the cleaning portions. In such a case, a cleaning portion exhibiting higher collecting capacity during movement in the first direction than that during movement in the second direction is employed as the first cleaning portion 26*a*, and a cleaning portion exhibiting higher collecting capacity during movement in the second direction than that during movement in the first direction is employed as the second cleaning portion 26*b*. In this case, the cleaning unit 20 performs cleaning during the movement in the first direction and during the movement in the second direction to increase the cleaning frequency and, while doing so, it is possible for the cleaning unit 20 to enhance the cleaning efficiency during movement in each direction.

Regarding the wiping member 27, if it is formed of a material of sufficient durability, it may be constructed so as to come into contact with the cover glass 31 on the forward way and on the backward way. On the other hand, in the case where it is possible to sufficiently remove the foreign matter G by the first cleaning portion 26*a* and the second cleaning portion 26*b* alone, there is no need to provide the wiping member 27.

Figure 11A:
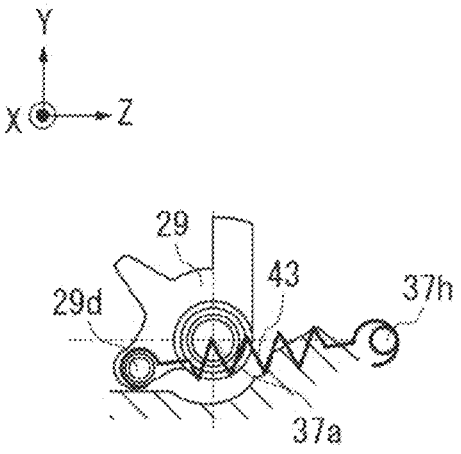
FIGS. 11A, 11B, 11C, and 11D are enlarged views of the switching unit.
Figure 11B:
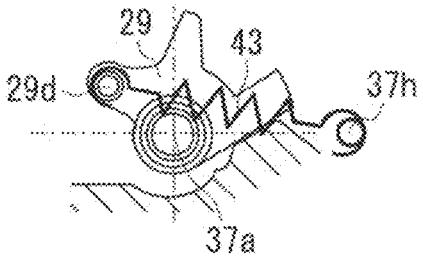
Figure 11C:
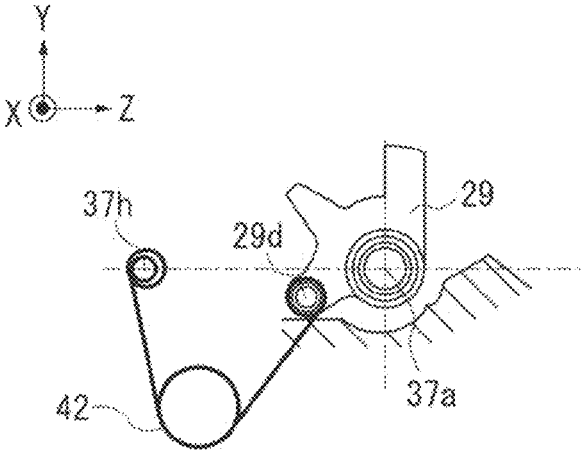
Figure 11D:
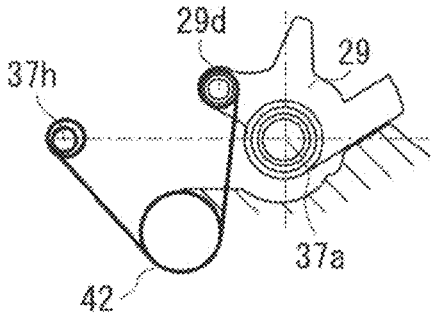

Further, while in the above example, the switching unit 40 is formed of the cam lever 29, the slide cam 36, and the cam spring 38, this should not be construed restrictively. It is also possible to adopt switching units as illustrated in FIGS. 11A and 11B. The switching unit illustrated in FIG. 11A is of a construction employing the cam lever 29 and a tension spring 43. One end of the tension spring 43 is hooked over a spring hook portion 37*h* of the slide member 37, and the other end thereof is hooked over the cam boss 29*d* of the lever cam 29. Similarly, the switching unit as illustrated in FIG. 11B is of a construction formed of the cam lever 29 and a torsion spring 42. One end of the torsion spring is rotatably hooked over the spring hook portion 37*h* of the slide member 37, and the other end thereof is hooked over the cam boss 29*d* of the lever cam 29.

In both the constructions of FIG. 11A and FIG. 11B, movement is made across the line connecting the rotation center of the cam lever 29 and the spring hook portion 37*h* of the slide member 37 through rotation of the position of the cam boss 29*d* constituting the other spring hook portion, whereby it is possible to switch the rotational moment around the rotation shaft 37*a* imparted by the pressing force of the tension spring 43 and of the torsion spring 42.

As described above, in the present exemplary embodiment, while the cleaning unit 20 is moved in the first direction, the first cleaning portion 26*a* is being brought into contact with the cover glass 31 to perform cleaning thereon, and the second cleaning portion 26*b* is moved away from it. And, while the cleaning unit 20 is moved in the second direction, the first cleaning portion 26*a* is moved away from the cover glass 31, and the second cleaning portion 26*b* is brought into contact therewith to perform cleaning thereon. As a result, while the cleaning unit 20 is moved in the first direction, and while it is moved in the second direction, it is possible to remove the foreign matter G on the cover glass 31, making it possible to increase the cleaning frequency. Further, while the cleaning unit 20 is moved in the second direction, the first cleaning portion 26*a* does not come into contact with the cover glass 31, so that it is possible to prevent the foreign matter G adhering to the first cleaning portion 26*a* from being allowed to adhere to the cover glass 31 again to remain thereon. Similarly, while it is moved in the first direction, the second cleaning portion 26*b* does not come into contact with the cover glass 31, so that it is possible to prevent the foreign matter G adhering to the second cleaning portion 26*b* from being allowed to adhere to the cover glass 31 again to remain thereon. That is, according to the present exemplary embodiment, it is possible to increase the cleaning frequency with respect to the number of times that the cleaning members move while suppressing the foreign matter adhering to the cleaning members (the first and second cleaning portions) when cleaning the transmission member (cover glass) from being allowed to adhere to the transmission member again to stain the transmission member.

Further, by providing the first cleaning portion dedicated to the cleaning at the time of movement in the first direction and the second cleaning portion dedicated to the cleaning at the time of movement in the second direction, it is possible to make each configuration of the first cleaning portion and the second cleaning portion optimum for respective cleaning performed when they are moving in each direction, so that it is possible to enhance the cleaning efficiency while increasing the cleaning frequency with respect to the number of times that the cleaning members move.

Further, regarding the wiping member 27, substantially the entire region thereof is spaced away from the surface of the cover glass 31 while the cleaning unit 20 is moved in the second direction. As a result, the wiping member 27 is not brought into contact with the cover glass 31 when it is not needed for cleaning, so that it is possible to suppress the collecting amount and damage of the wiping member 27, making it possible to increase its service life. Further, the wiping member 27 performs cleaning mainly at the time of insertion of the cartridge 7, so that, as compared with the case where it performs cleaning at the time of extraction of the cartridge 7, it is possible to reliably perform cleaning on the cover glass 31 at the time of the final operation prior to the image formation, i.e., at the time of the operation of inserting the cartridge 7.

Next, a second exemplary embodiment will be described. The present exemplary embodiment differs from the first exemplary embodiment in that a cleaning unit is not moved with respect to the cover glass but that the cover glass itself is moved with respect to the cleaning unit. Otherwise, it is of the same construction as the first exemplary embodiment, so the same components are indicated by the same reference numerals, and the description thereof will be left out.

Figure 12:
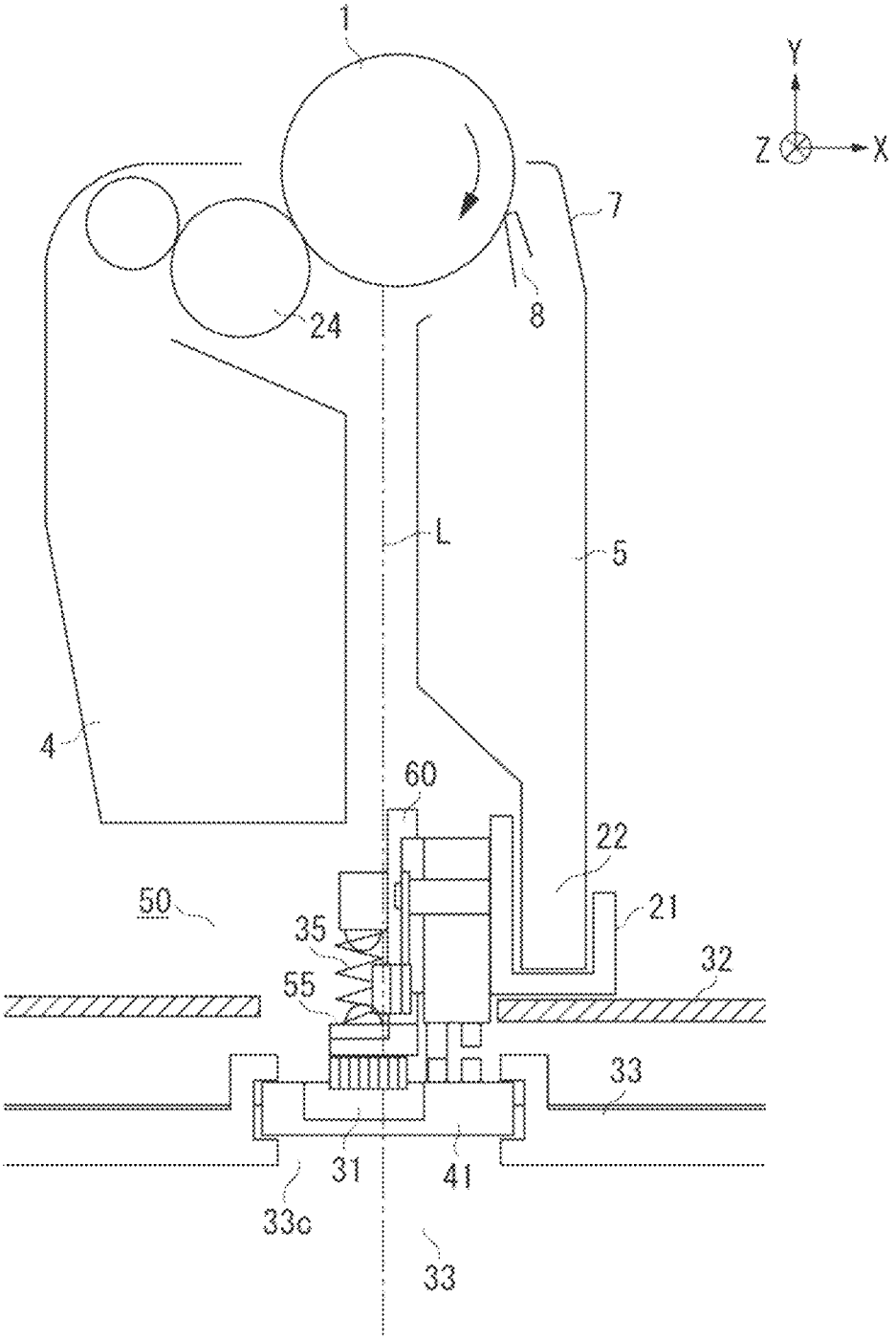
FIG. 12 is a sectional view of the cartridge attached to the apparatus main body and its vicinity.

FIG. 12 is a sectional view of one cartridge 7 attached to the apparatus main body 100 and its vicinity as seen from the +Z direction. In the second exemplary embodiment, it is possible to pull out the cover glass 31 in the −Z direction and to insert it in the +Z direction with respect to the apparatus main body 100. This is for the purpose of allowing the user or the serviceman to extract the cover glass 31 itself and to perform maintenance thereon such as cleaning or replacement when deposit has been accumulated on the cover glass 31, resulting in a defective image.

The cover glass 31 is equipped with a holder case 41 which is integrally mounted so as to cover the cover glass 31 and which forms a slide guide portion for inserting and extracting operation. The holder case 41 is arranged so as to cause two slide engagement ribs 41*a* and 41*b* to protrude from the upper surface of the holder case 41, and the exposure region EA is provided with a cutout window (not illustrated) for allowing the light emitted from the optical unit 3 to be transmitted therethrough.

[Cleaning Unit 50]

Figure 13:
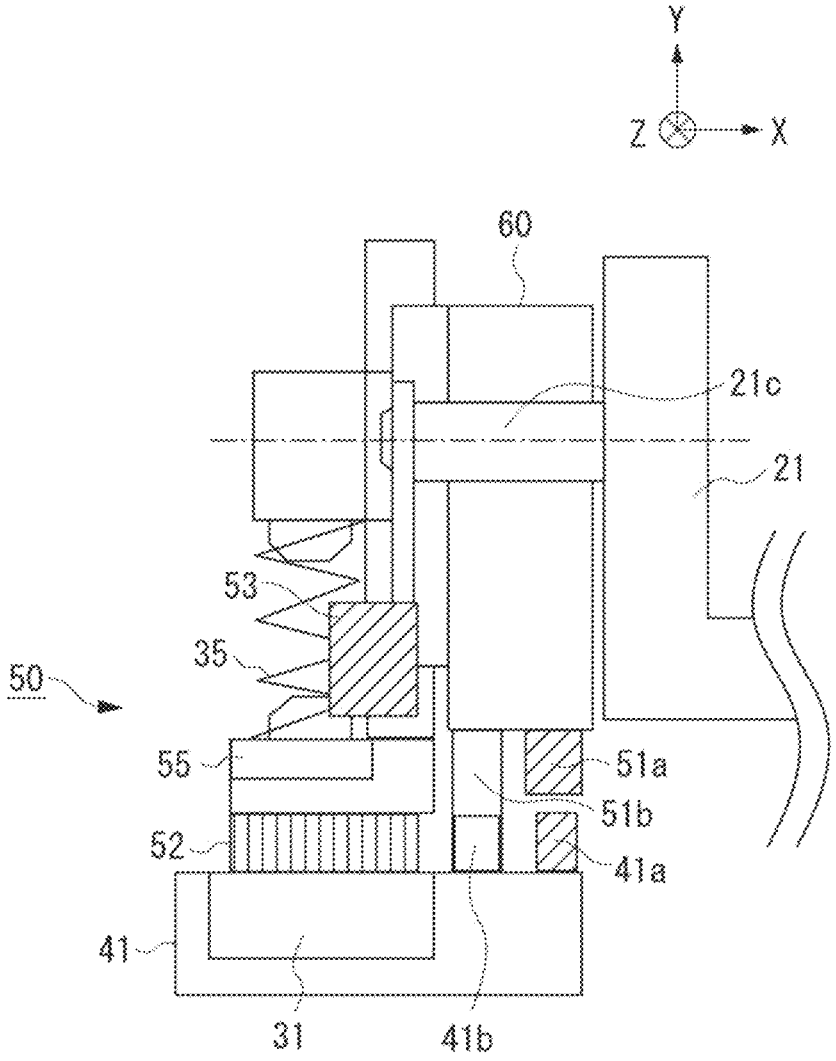
FIG. 13 is a sectional view of a cover glass and a cleaning unit as seen from the +Z direction.
Figure 14:
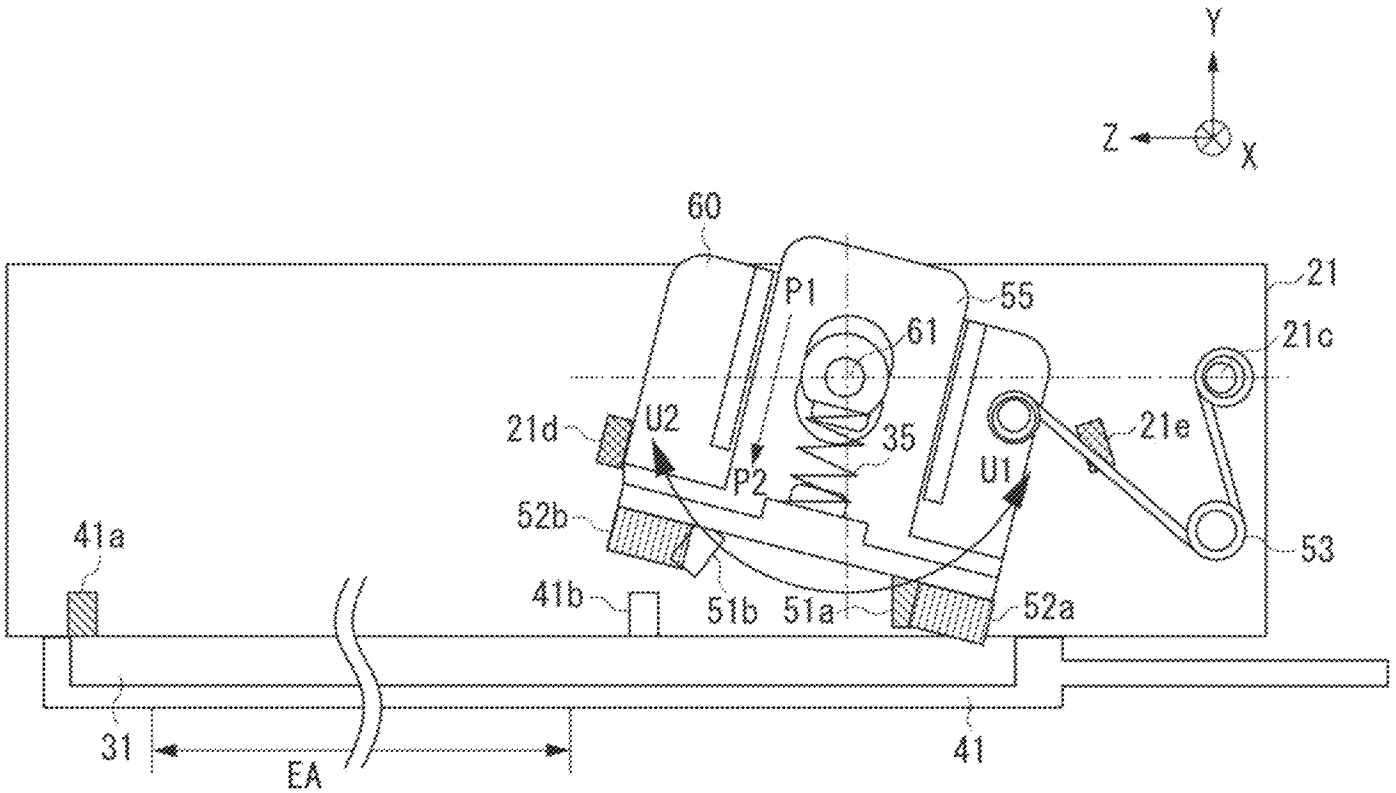
FIG. 14 is a diagram illustrating the cover glass and the cleaning unit as seen from the +X direction.

FIG. 13 is a sectional view of the cover glass 31 and a cleaning unit 50 as seen from the +Z direction, and FIG. 14 is a side view of the cover glass 31 and the cleaning unit 50 as seen from the +X direction. The cleaning unit 50 is fixed to the insertion guide 21, which is incorporated into the stay member 32, at a position on the upstream side in the +Z direction of the exposure region EA of the optical unit 3.

A swinging member 55 has two sponge-like cleaning portions (a first cleaning portion 52*a* and a second cleaning portion 52*b*), and is configured to be swung by a switching mechanism 60. Further, the swinging member 55 is retained so as to be slidable in directions P1 and P2 illustrated in FIG. 14, and presses the first cleaning portion 52*a* or the second cleaning portion 52*b* toward the cover glass 31 by the spring 35. Here, the cleaning unit 50 is restrained in the Z direction, and is set in position in the Y direction by crushing a cleaning portion 52 to a certain extent against the surface of the cover glass 31 by the pressing force of the spring 35. The switching mechanism 60 has two switching lever portions 51*a* and 51*b*, and slidably retains the swinging member 55. The switching mechanism 60 is mounted so as to be rotatable in directions U1 and U2 illustrated in FIG. 14 around a rotation shaft 61 provided on the insertion guide 21. The switching lever portions 51*a* and 51*b* are arranged at positions differing in the Z direction. They are arranged in an engagement relationship with the slide engagement portions 41*a* and 41*b* provided on the holder case 41. The insertion guide 21 has a spring hook boss 21*c*, and rotatably retains one end of the arm portion of a torsion spring 53. The arm portion at the other end of the torsion spring 53 is rotatably mounted to a part of the switching mechanism 60. As a result, a fixed rotational moment around the rotation shaft 61 is imparted to the switching mechanism 60 so that it can rotate up to the positions where it abuts stoppers 21*d* and 21*e* provided on the insertion guide 21.

[Operation when the Cover Glass 31 is Extracted]

Figure 15A:
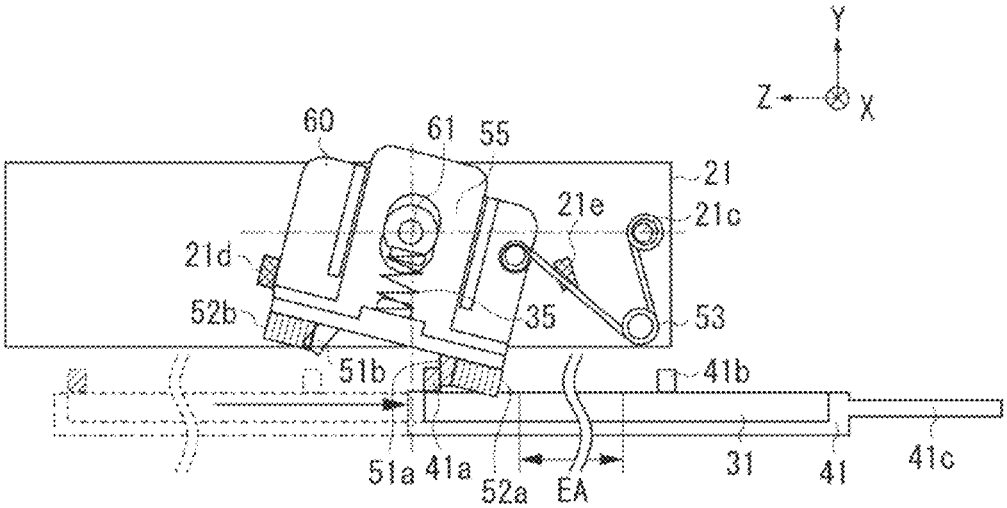
FIGS. 15A and 15B are diagrams illustrating the cover glass and the cleaning unit as seen from the +X direction.

Next, the cleaning operation performed by the cleaning unit 50 when the cover glass 31 is inserted and extracted in the ±Z directions will be described with reference to FIGS. 15A, 15B, 16A, and 16B. FIGS. 15A, 15B, 16A, and 16B are diagrams illustrating the cover glass 31 and the cleaning unit 50 as seen from the +X direction. FIG. 15A illustrates how the cover glass 31 slide-installed in the optical unit 3 is pulled out of the image forming apparatus main body 100 in the −Z direction. When a user or a serviceman grasps a handle portion 41*c* of the holder case 41 and performs the extracting operation in the −Z direction, adhering substance is scraped off by the first cleaning portion 52*a* which is held in contact with the upper surface of the cover glass 31. At this time, the first cleaning portion 52*a* is pressed toward the surface of the cover glass 31 by the spring 35. However, the sliding resistance between the cover glass 31 and the first cleaning portion 52*a* is relatively low, and does not exceed the rotation maintaining force of the switching element 60 (the rotational moment around the rotation shaft 61 imparted by the spring 35). Thus, cleaning is performed while maintaining the attitude of the switching mechanism 60. At this time, the second cleaning portion 52*b* is retracted to a position where it is not in contact with the cover glass 31. The slide engagement portion 41*b* of the holder case 41 is in a height positional relationship in which it does not interfere with the lever portion 51*b* by the attitude of the switching mechanism 60.

Figure 15B:
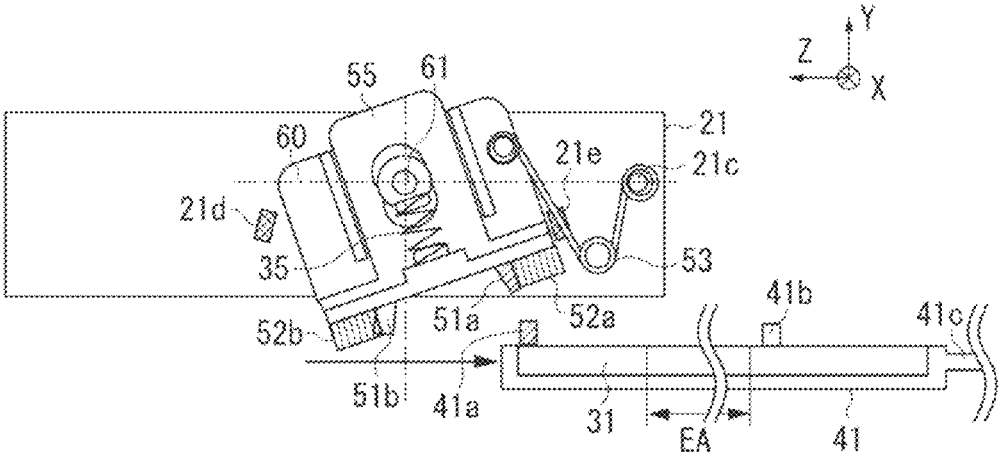

When the holder case 41 is further pulled out, the lever portion 51*a* of the switching mechanism 60 and the slide engagement portion 41*a* of the holder case 41 are engaged with each other to swing-change the tilting attitude of the switching mechanism 60 to the opposite side as illustrated in FIG. 15B. At this time, the switching mechanism 60 receives from the slide engagement rib 41*a* a force in excess of a fixed swing-urging force imparted by the torsion spring 53, so that the rotation attitude of the switching mechanism 60 is switched. As a result, the first cleaning portion 52*a* of the swinging member 55 moves to a position retracted from the surface of the cover glass 31, and the second cleaning portion 52*b* moves to a position where it can come into contact with the surface of the cover glass 31 when attaching the cover glass 31.

[Operation when the Cover Glass 31 is Inserted]

Figure 16A:
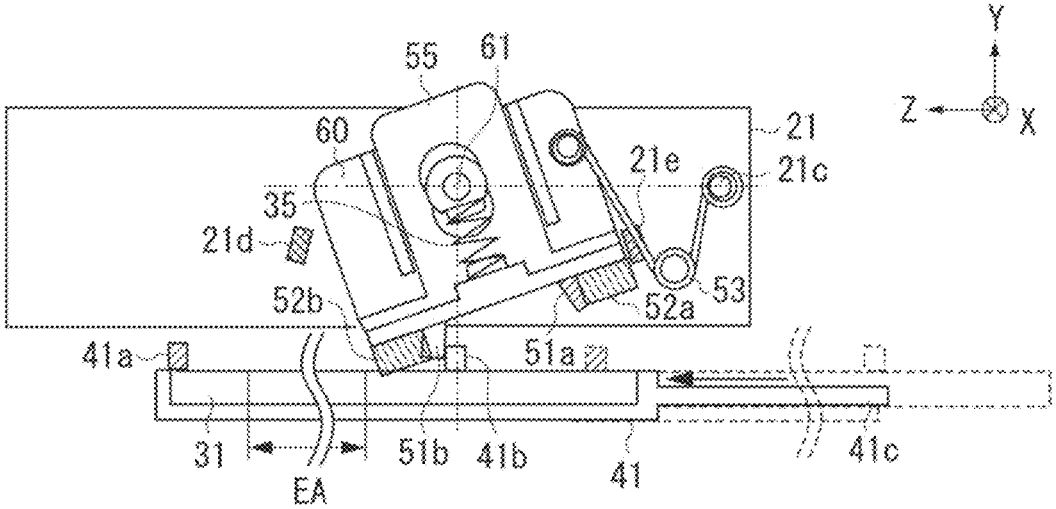
FIGS. 16A and 16B are diagrams illustrating the cover glass and the cleaning unit as seen from the +X direction.

Next, the operation when the cover glass 31 is attached to the apparatus main body 100 as illustrated in FIG. 16A will be described. When the cover glass 31 is inserted and attached in the +Z direction along with the holder case 41, the second cleaning portion 52*b* of the swinging member 55 comes into contact with the cover glass 31 to clean the same. At this time, the first cleaning portion 52*a* is not brought into contact with the cover glass 31 so that the foreign matter G scraped off by the first cleaning portion 52*a* may not adhere to the cover glass 31.

Figure 16B:
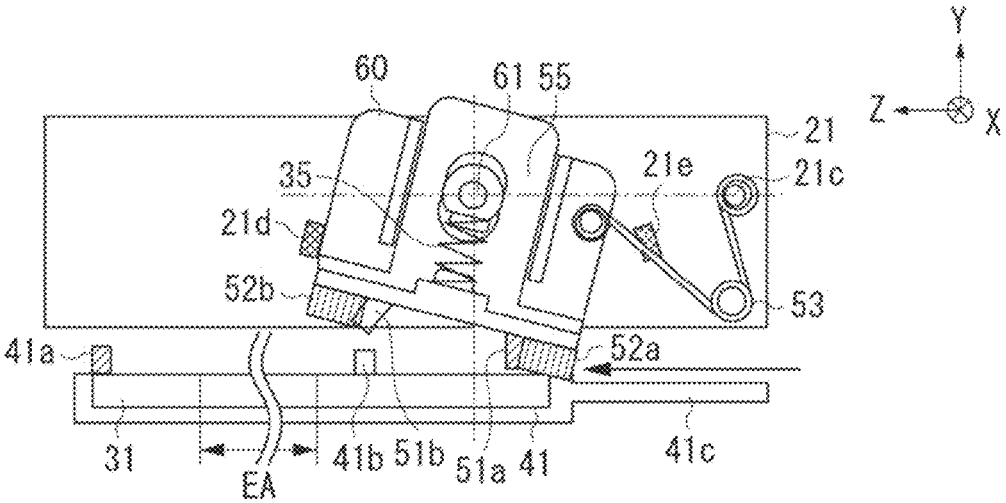

After this, when the cover glass 31 is inserted to the position for performing image formation, the slide engagement portion 41*b* of the holder case 41 is engaged with the lever portion 51*b* of the switching mechanism 60 to switch the tilting attitude of the switching mechanism 60 as illustrated in FIG. 16B. As a result, the second cleaning portion 52*b* moves to the retracted position, and the first cleaning portion 52*a* moves to the position where it comes into contact with the cover glass 31 when the cover glass 31 is pulled out in the −Z direction.

As described above, in the present exemplary embodiment, it is possible to attain the same effect as that of the first exemplary embodiment. That is, when the cleaning is performed on the surface of the cover glass 31 simultaneously with the insertion and extraction of the cover glass 31 into and out of the apparatus main body 100, it is possible to perform cleaning by a cleaning member corresponding to each of the moving directions in both the attachment and extraction of the cover glass 31. Thus, it is possible to prevent foreign matter once allowed to adhere to the cleaning members from being allowed to adhere to the cover glass 31 again while increasing the cleaning frequency. That is, according to the present exemplary embodiment, it is possible to increase the cleaning frequency with respect to the number of times that the transmission member moves while suppressing foreign matter adhering to the cleaning members (first and second cleaning portions) when cleaning the transmission member (cover glass) from adhering to the transmission member again to stain the transmission member.

While in the two exemplary embodiments described above there is used a cleaning unit configured to clean the cover glass 31 of the optical unit 3, this should not be construed restrictively. That is, the present invention is applicable to various cleaning units configured to clean a light transmission member in an image forming apparatus. For example, the present invention is also applicable to a cleaning unit for the transparent window portion of a detection unit of a toner patch detection device configured to detect patch toner transferred onto the belt surface of a transfer belt. Further, the present invention is also applicable to a cleaning unit configured to clean the reading glass of a feeding-reading type image reading apparatus.

Next, a third exemplary embodiment will be described. The present exemplary embodiment differs from the first exemplary embodiment in that a cleaning unit has only one cleaning portion. Otherwise, it is of the same construction as the first exemplary embodiment, so the same components are indicated by the same reference numerals, and the description thereof will be left out.

FIGS. 17A, 17B, 18A, and 18B are diagrams illustrating a cleaning mechanism in the apparatus main body 100 as seen from the −X direction. In a cleaning unit 320 according to the present exemplary embodiment, a slide member 337 supports a swinging member 339 so as to allow it to swing around an axis R, and the swinging member 339 is equipped with a cleaning blade 326 as a single cleaning portion. The angle at which the cleaning blade 326 is held in contact with the cover glass 31 can be changed. As in the first exemplary embodiment, the cleaning unit 320 is pressed by a cartridge (not illustrated) and cleans the cover glass 31 while moving in the +Z direction and the −Z direction. Further, the cleaning unit 320 is equipped with a switching unit (not illustrated) similar to that of the first exemplary embodiment, and swings the swinging member 339 in conjunction with the operation of inserting and extracting the cartridge, changing its position with respect to the slide member 337.

[Operation when the Cartridge is Inserted]

Figure 17A:
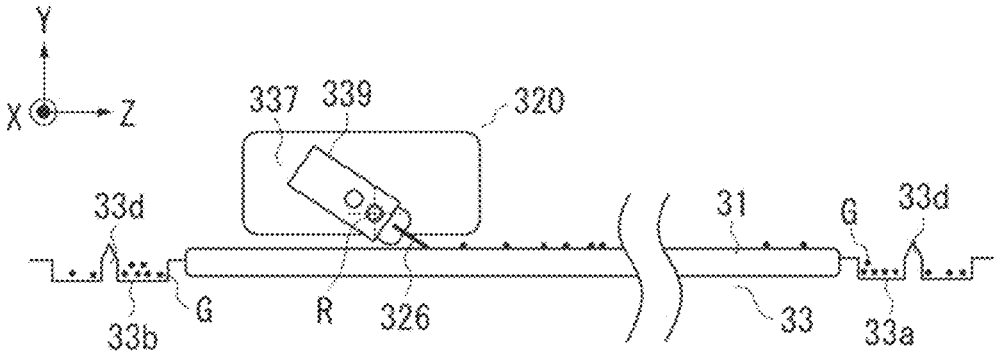
FIGS. 17A and 17B are diagrams illustrating a cleaning mechanism as seen from the −X direction.
Figure 17B:
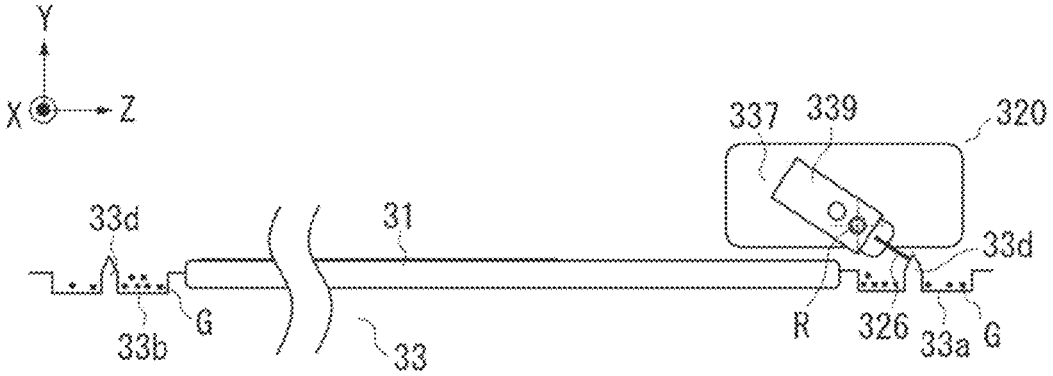

As illustrated in FIG. 17A, when inserting the cartridge, the cleaning unit 320 moves in the +Z direction (the first direction). At this time, the swinging member 339 is at a first position with respect to the slide member 337, and the cleaning blade 326 comes into contact with the cover glass 31 in the counter direction. That is, the cleaning blade 326 is held in contact with the cover glass 31 at an angle such that a vector (inclusive of a +Z direction component) indicating the direction from the root toward the leading edge portion along the blade surface and a vector indicating the moving direction (−Z direction) of the cover glass 31 as seen from the leading edge portion when performing cleaning while held in contact with the cover glass 31 respectively have vector components opposite each other. Due to the shock when the cleaning blade 326 passes a step portion at the downstream side end portion in the +Z direction of the cover glass 31 and due to its own weight, it moves the foreign matter G that it has scraped off to the groove-shaped collecting portion 33*a* provided in the upper portion of the casing 33 of the optical unit 3 and stores it therein. Further, as illustrated in FIG. 17B, a protrusion 33*d* is provided in the collecting portion 33*a*. When the cleaning blade 326 passes the position of the protrusion 33*d*, it comes into contact with the protrusion 33*d*, and can, due to the shock thereof, drop the foreign matter G on the cleaning blade 326 into the collecting portion 33*a*.

When the cleaning blade 326 has gone beyond the protrusion 33*d*, the cleaning unit 320 abuts a stopper (not illustrated) and stops there. And, as illustrated in FIG. 18A, as in the first exemplary embodiment, by further inserting the cartridge in the +Z direction, the swinging member 339 rotates clockwise around the axis R as seen in FIG. 18A, and the swinging member 339 moves to a second position with respect to the slide member 337.

[Operation when the Cartridge is Extracted]

Figure 18A:
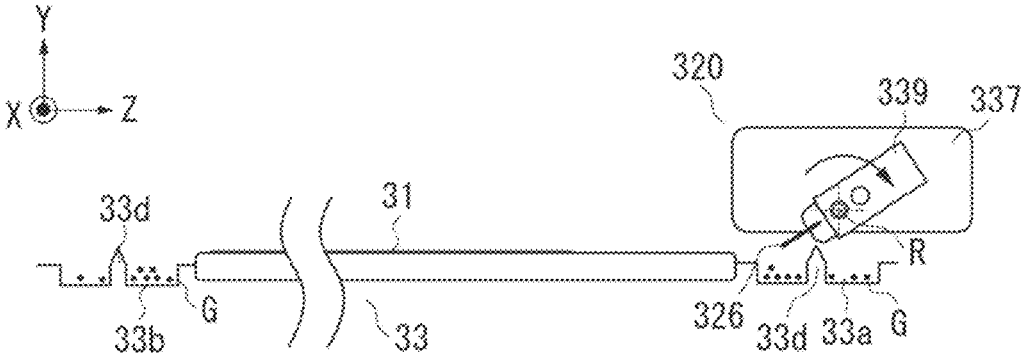
FIGS. 18A and 18B are diagrams illustrating the cleaning mechanism as seen from the −X direction.
Figure 18B:
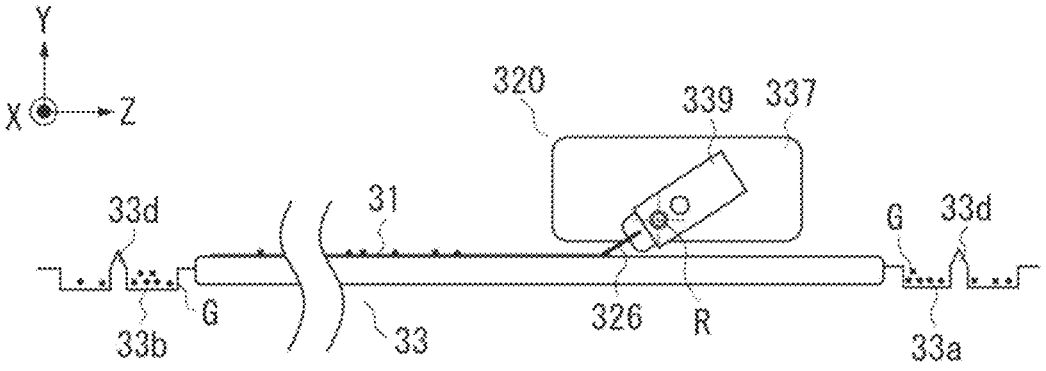

When pulling out the cartridge, the cleaning unit 320 moves in the −Z direction (the second direction) while in the state as illustrated in FIG. 18A. At this time, as illustrated in FIG. 18B, the swinging member 339 is at the second position with respect to the slide member 337, and the cleaning blade 326 comes into contact with the cover glass 31 in the counter direction. While moving downstream in the −Z direction, it scrapes off the foreign matter G on the cover glass 31, and moves it in the −Z direction. From this onward, as in the case of inserting the cartridge, due to the shock when the cleaning blade 326 passes a step portion at the downstream side end portion in the −Z direction of the cover glass 31 and due to its own weight, it moves the foreign matter G that it has scraped off to the collecting portion 33*b* and stores it therein. Further, when the cleaning blade 326 passes the position of the protrusion 33*d*, it comes into contact with the protrusion 33*d*, and can, due to the shock thereof, drop the foreign matter G on the cleaning blade 326 into the collecting portion 33*b*.

And, when the cleaning blade 326 has gone beyond the protrusion 33*d*, the cleaning unit 320 abuts a stopper (not illustrated) and stops there, and, as in the first exemplary embodiment, by completely pulling out the cartridge in the −Z direction, the swinging member 339 rotates counterclockwise around the axis R. As a result, the swinging member 339 moves to the first position with respect to the slide member 337.

The method of moving the swinging member 339 with respect to the slide member 337 is not restricted to the swinging around the X-axis. Any method will do so long as it helps to change the orientation, attitude, etc. of the cleaning blade 326 with respect to the cover glass 31.

The above-described construction makes it possible to attain the same effect as that of the first exemplary embodiment. That is, it is possible to remove the foreign matter G on the surface of the cover glass 31 while the cleaning unit 320 moves in the first direction, and while it moves in the second direction, making it possible to increase the cleaning frequency. Further, by the protrusion 33*d*, it is possible to remove the foreign matter G on the cleaning blade 326. Thus, it is possible to prevent the foreign matter G adhering to the cleaning blade 326 from being allowed to adhere to the cover glass 31 again to remain thereon when the cleaning unit 320 moves in a different direction.

Generally speaking, when a cleaning portion is formed of a blade-like or sheet-like member and is based on the cleaning concept of "scraping off and moving the foreign matter G on the cover glass 31," and if its angle with respect to the cover glass 31 is fixed, it can only effectively scrape off and move the foreign matter G while it is moving in a fixed direction, that is, such a cleaning portion exhibits directivity in cleaning capacity. On the other hand, in the present exemplary embodiment, the swinging member 339 is caused to swing, and its angle (attitude) with respect to the slide member 337 is changed, whereby its angle (attitude) with respect to the cover glass 31 is changed. As a result, it is possible to effectively scrape off the foreign matter G both while it is moving in the first direction and while it is moving in the second direction. Thus, cleaning is performed while the cleaning unit 20 is moving in the first direction and while it is moving in the second direction, whereby it is possible to enhance the cleaning efficiency when performing cleaning in each direction while increasing the cleaning frequency. Further, with one cleaning portion (cleaning blade 326), it is possible to scrape off the foreign matter G on the cover glass 31 when it moves in the first direction and in the second direction, so that it is possible to form the cleaning unit 320 at still lower cost. Further, so long as the cleaning portion exhibits directivity in cleaning capacity, it is also possible to adopt a cleaning portion based on a cleaning concept different from that of the present invention, i.e., the cleaning concept of "scraping off and moving the foreign matter G on the cover glass 31."

Next, a fourth exemplary embodiment will be described. The present exemplary embodiment differs from the first exemplary embodiment in the end portion configuration of the base member 28 and the configuration of the cleaning sheet. In the following, the same components as those of the first exemplary embodiment are indicated by the same reference numerals, and the detailed description thereof will be left out.

[Cleaning Unit 20]

Figure 21A:
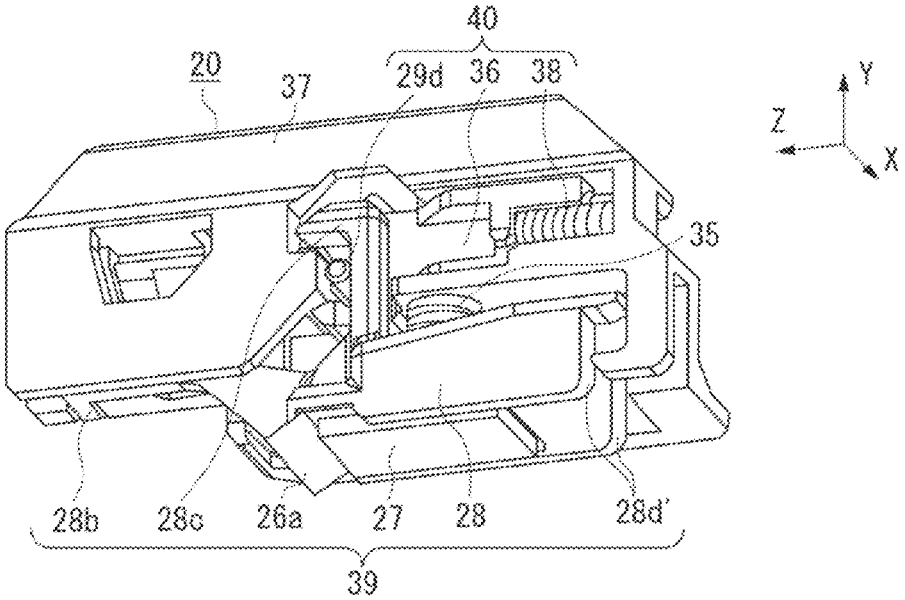
FIG. 21A is a perspective view of the cleaning unit.
Figure 21B:
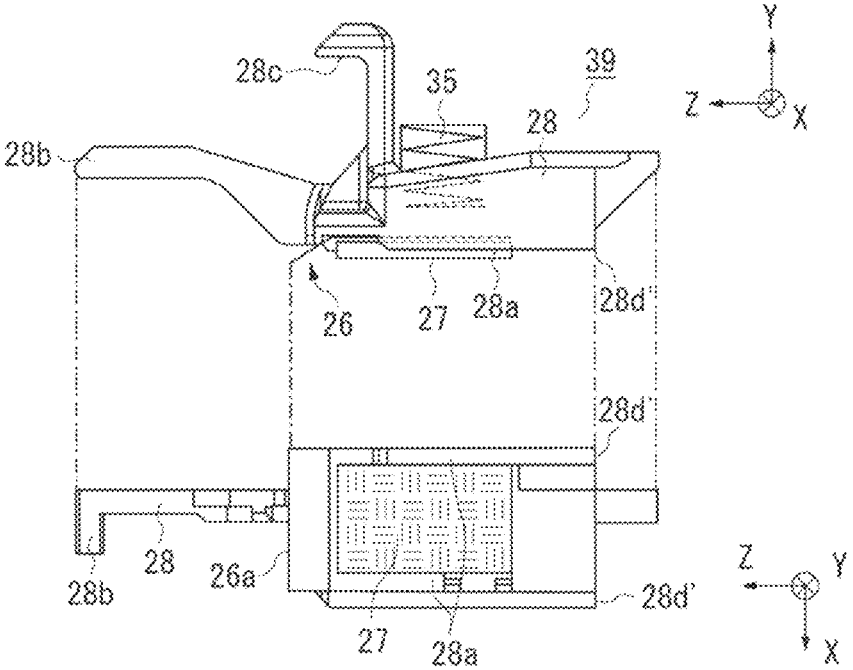
FIG. 21B is a side view and a bottom view of the swinging member.

The cleaning unit 20 will be described. FIG. 21A is a perspective view of the cleaning unit 20 constituting the cleaning mechanism. The components constituting the cleaning unit 20 are the same as those of the first exemplary embodiment. FIG. 21B is a side view (upper side) and a bottom view (lower side) of the swinging member 39. As in the first exemplary embodiment, the swinging member 39 is composed of the base member 28, the flexible cleaning sheet 26 fixed to the bottom surface of the base member 28, and the wiping member 27 superimposed on and attached to the cleaning sheet 26.

The cleaning sheet 26 is formed by bending a film-like sheet material, and one end thereof in the Z direction is formed as the cleaning portion 26*a*. When it performs cleaning on the cover glass 31 while in contact therewith, the cleaning portion 26*a* comes into contact with the cover glass 31 in the counter direction with respect to the advancing direction, and scrapes off (sweeps) and moves the foreign matter G on the cover glass 31. The wiping member 27 is formed of polyester non-woven cloth (fiber-like material) as in the first exemplary embodiment.

The abutment surface 28*a* and an abutment surface 28*d'* are provided at both ends in the X direction of the wiping member 27 at the bottom surface of the base member 28. Here, the abutment surface 28*d'* is arranged on the −Z direction side of the position of the abutment surface 28*d* of the first exemplary embodiment. As described below, this serves as a fulcrum when spacing the cleaning portion 26*a* and the wiping member 27 away from the cover glass 31. Depending upon the position around the X-axis of the swinging member 39, one of the abutment surfaces 28*a* and 28*d'* abuts the cover glass 31, regulating the position in the Y direction of the cleaning sheet 26 and of the wiping member 27. By causing the abutment surface 28*a* to abut the cover glass 31, the cleaning portion 26*a* of the cleaning sheet 26 is reliably brought into contact with the surface of the cover glass 31 in a deflected state, and the wiping member 27 is brought into press contact with the surface of the cover glass 31 in a state in which it is crushed in the thickness direction (the Y direction).

The switching unit 40 is the same as that of the first exemplary embodiment, so the description thereof will be left out.

[Operation of Cleaning the Cover Glass 31]

Next, the operation of cleaning the cover glass 31 will be described. FIGS. 22A, 22B, 23A, 23B, 24A, and 24B are diagrams illustrating the cleaning mechanism in the apparatus main body 100 as seen from the −X direction. FIGS. 25A and 25B are diagrams illustrating the cleaning unit 20 as seen from the +X direction. The cleaning unit 20 moves in conjunction with the insertion and extraction of the cartridge 7 to be inserted into the apparatus main body 100.

[Operation when the Cartridge 7 is Inserted]

Figure 22A:
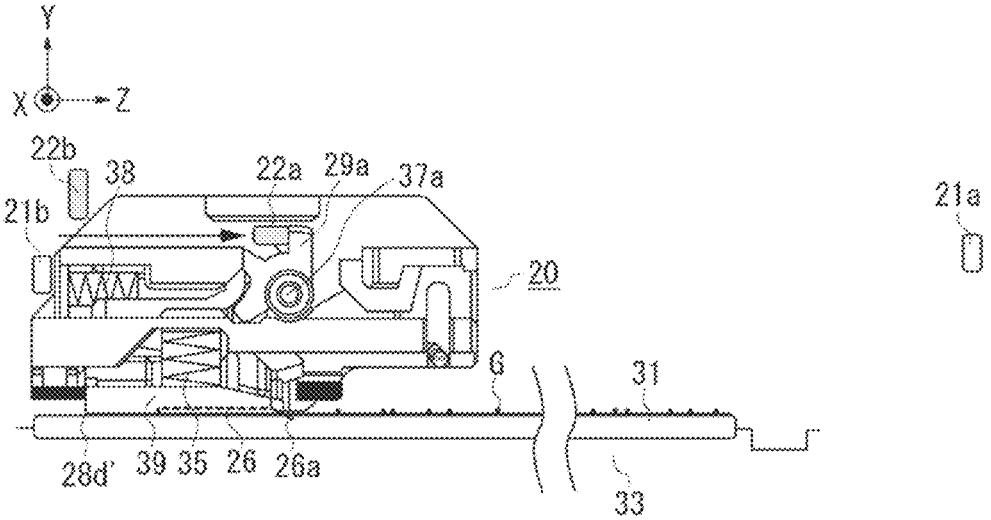
FIGS. 22A and 22B are diagrams illustrating a cleaning mechanism as seen from the −X direction.

The cleaning operation by the cleaning unit 20 on the forward way, the operation when the cartridge 7 is inserted into the apparatus main body 100 to which no cartridge 7 has been attached will be described. FIG. 22A illustrates the state before the attachment of the cartridge 7 to the apparatus main body 100, i.e., the state in which the cleaning unit 20 is kept on standby at the home position. Foreign matter G such as toner and dust including paper dust adheres to the surface of the cover glass 31. In this state, the cleaning portion 26*a* of the cleaning sheet 26 and the wiping member 27 are in contact with the cover glass 31. When the cartridge 7 is inserted into the apparatus main body 100 in the Z direction to attach it thereto, the engagement portion 22*a* abuts and is engaged with the first lever portion 29*a* of the cam lever 29.

Figure 22B:
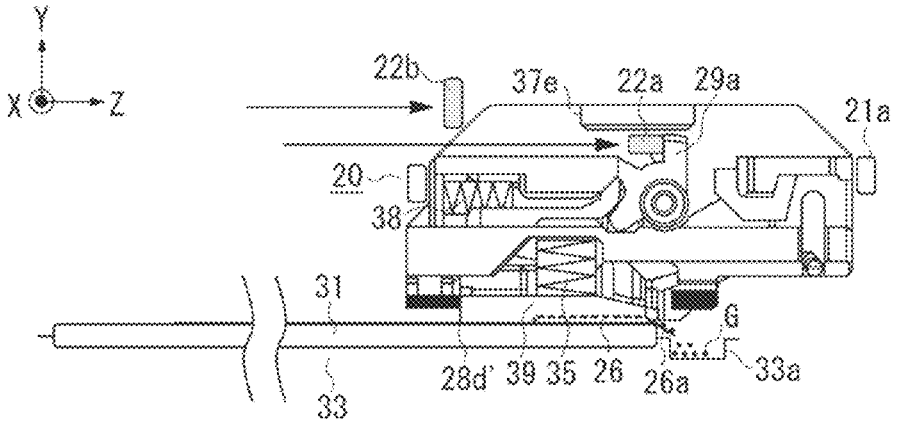

Next, as illustrated in FIG. 22B, when the cartridge 7 is further pushed in after the engagement portion 22*a* has abutted the first lever portion 29*a*, since the rotation of the cam lever 29 is restricted by the pressing force of the spring 38, the cleaning unit 20 is pressed by the engagement portion 22*a* of the cartridge 7 to move in the +Z direction (the first direction).

While the cleaning unit 20 is moving in the +Z direction, the cleaning portion 26*a* of the cleaning sheet 26 scrapes off the foreign matter G on the cover glass 31 and causes it to move downstream in the +Z direction. The foreign matter G that has not been scraped off by the cleaning portion 26*a* is collected by the wiping member 27. Due to the shock when it passes a step portion at the downstream side end portion in the +Z direction of the cover glass 31 and due to its own weight, the cleaning portion 26*a* moves the foreign matter G that it has scraped off to the groove-shaped collecting portion 33*a* provided in the upper portion of the casing 33 of the optical unit 3 and stores it therein. After this, the cleaning unit 20 abuts the stopper 21*a* provided on the downstream side in the +Z direction of the insertion guide 21 and stops there. In this state, the position of the cartridge 7 with respect to the apparatus main body 100 has not been determined yet.

Figure 23A:
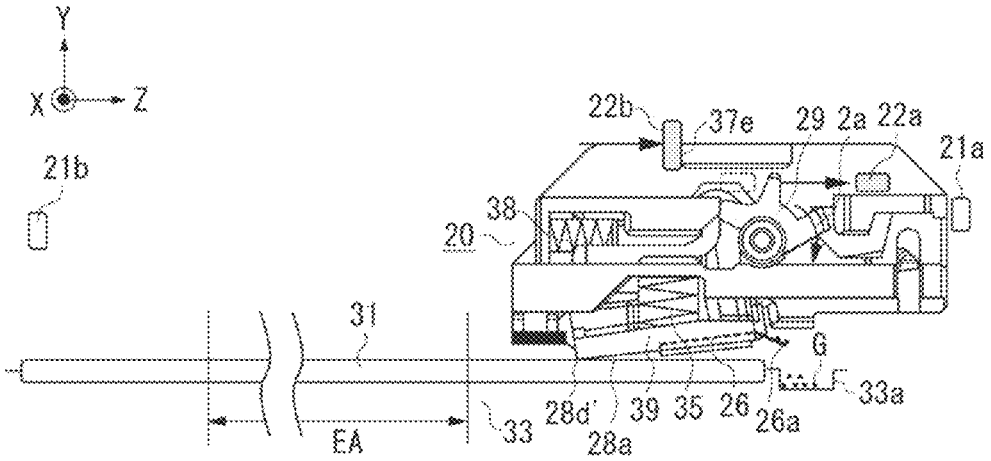
FIGS. 23A and 23B are diagrams illustrating the cleaning mechanism as seen from the −X direction.

When, the cartridge 7 is further moved in the +Z direction, and is inserted to a position where it is set in position with respect to the image forming apparatus main body 100, the engagement portion 22*a* rotates the cam lever 29 clockwise as illustrated in FIG. 23A. Through the clockwise rotation of the cam lever 29, the attitude of the swinging member 39 is changed, and the cleaning portion 26*a* of the cleaning sheet 26 and the wiping member 27 are retracted upwards away from the cover glass 31 to be placed in a state in which they are not in contact therewith.

The swinging of the swinging member 39 at the time of rotation of this cam lever 29 will be described in detail. Before the rotation of the cam lever 29, the swinging member 39 is at a first position as illustrated in FIG. 25A, and the cleaning portion 26*a* of the cleaning sheet 26 comes into contact with the cover glass 31 in a deflected state. Further, the wiping member 27 is also held in press contact with the cover glass 31. At this time, the abutment surface 28*a* of the base member 28 is held in contact with the cover glass 31.

As illustrated in FIG. 25B, when the cam lever 29 rotates, the cam boss 29*d* of the cam lever 29 upwardly presses the pressed portion 28*c* of the base member 28, and the abutment portion 28*d*' comes into contact with the cover glass 31 to serve as a fulcrum, with the base member 28 being inclined with respect to the cover glass 31. That is, the position of the swinging member 39 with respect to the slide member 37 has been changed from the first position to a second position. At this time, the abutment surface 28*d*' of the base member 28 is held in contact with the cover glass 31, and the entire region of the cleaning sheet 26 and of the wiping member 27 is retracted from the cover glass 31.

[Operation when the Cartridge 7 is Extracted]

Next, to be described will be the cleaning operation by the cleaning unit 20 on the backward way when the cartridge 7 attached to the apparatus main body 100 is pulled out of the apparatus main body 100 to be detached from the apparatus main body 100.

Figure 23B:
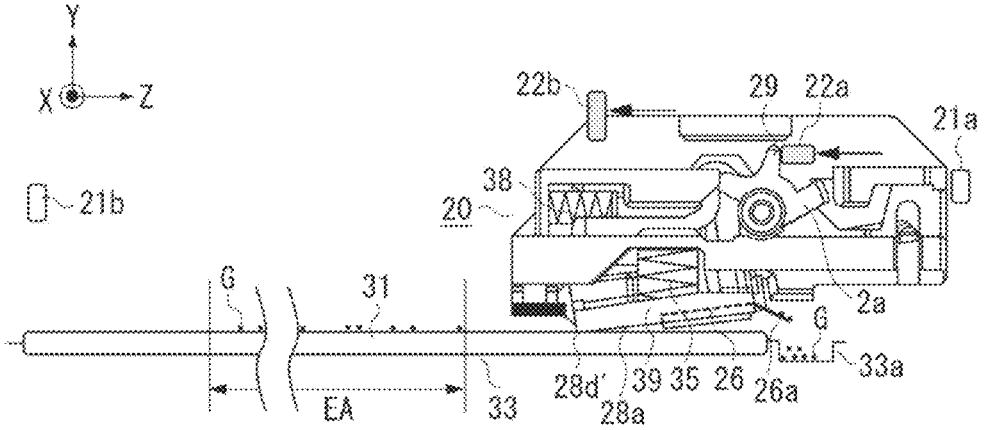

As illustrated in FIG. 23B, when the cartridge 7 is pulled out, the engagement portion 22*a* abuts the second lever portion 29*b* of the cam lever 29 to press it in the −Z direction, and the cleaning unit 20 moves in the −Z direction (the second direction).

While the cleaning unit 20 is moving in the −Z direction, the cleaning portion 26*a* and the wiping member 27 cause the cleaning unit 20 to move in the −Z direction without touching the foreign matter G accumulated on the cover glass 31.

Figure 24A:
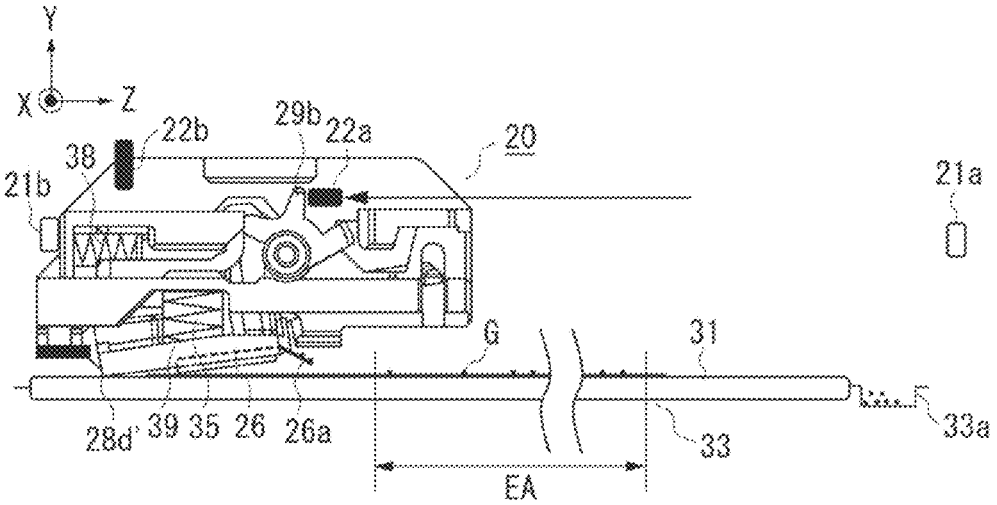
FIGS. 24A and 24B are diagrams illustrating the cleaning mechanism as seen from the −X direction.
Figure 25A:
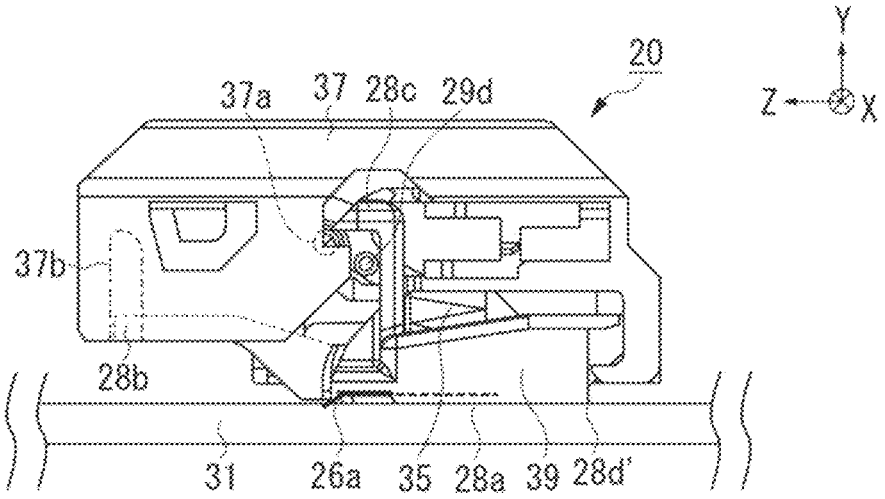
FIGS. 25A and 25B are diagrams illustrating the cleaning mechanism as seen from the +X direction.
Figure 25B:
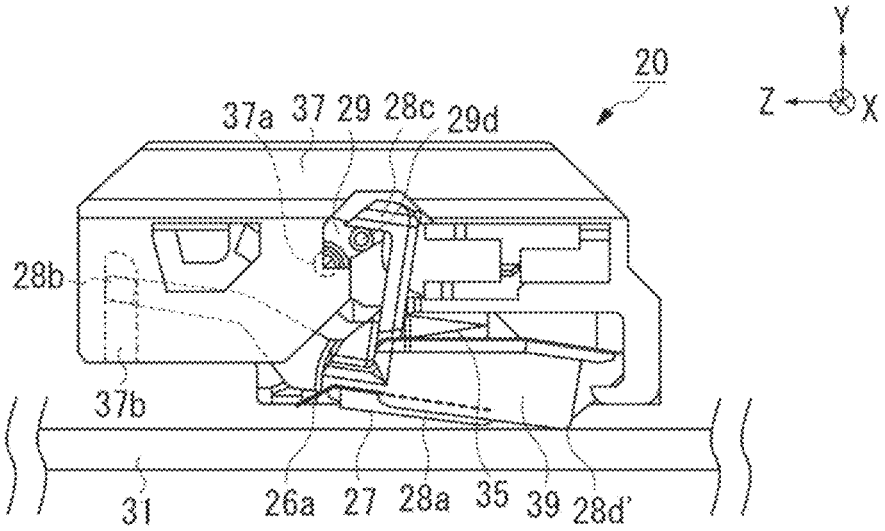

As illustrated in FIG. 24A, the cleaning unit 20 abuts the stopper 21*b* provided on the upstream side in the +Z direction of the insertion guide 21 and stops there.

Figure 24B:
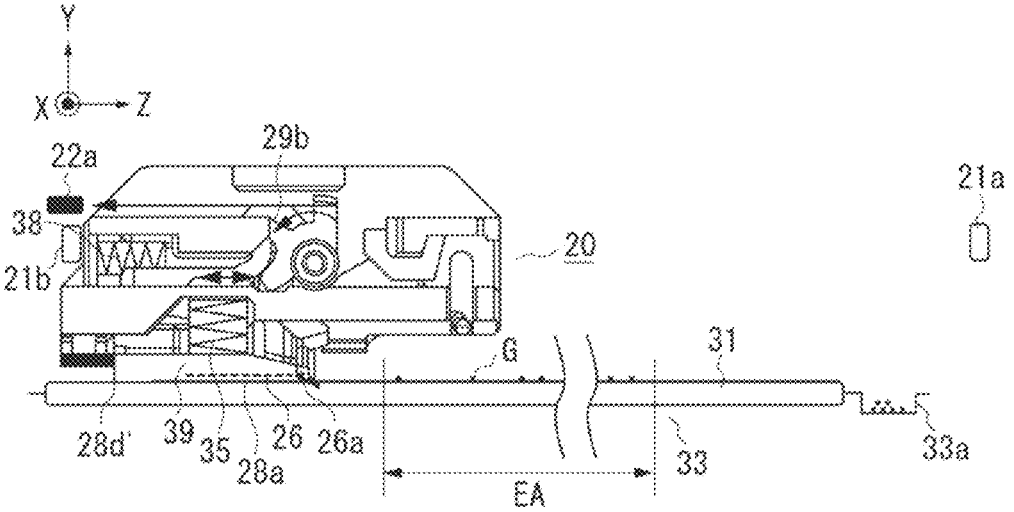

When the cartridge is completely pulled out of the image forming apparatus main body 100, the engagement portion 22*a* rotates the cam lever 29 counterclockwise as illustrated in FIG. 24B. As a result, the upward pressing of the pressed portion 28*c* of the base member 28 by the cam boss 29*d* is released, and the cleaning member 39 returns to the first position. And, the cleaning portion 26*a* of the cleaning sheet 26 is brought into contact with the cover glass 31, and is restored to the standby state at the home position where the cover glass is cleaned when the cartridge is inserted next.

As described above, in the fourth exemplary embodiment, it is possible to switch the attitude of the cover glass cleaning mechanism in conjunction with the attachment/detachment operation in one direction of the cartridge, and there is no need for a user or an operator such as a serviceman to perform any bothersome operation. Further, the insertion guide guiding the insertion and extraction of the cartridge slidably retains the cleaning unit configured to slide-move in the attachment direction, so that the number of components is reduced to simplify the construction, and the requisite precision for the engagement positional relationship with the cartridge is easily guaranteed. Further, the mechanism for switching the attitude of the cleaning member is formed to be compact, which contributes to an overall reduction in the size of the apparatus as a whole.

Further, the present invention is applicable not only to a cartridge unit but also to other constructions in which a similar cleaning function is imparted to the attachment/detachment guide portion of a maintenance unit, which proves the present invention superior in versatility, too.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-263261 filed Nov. 30, 2012 and No. 2013-219645 filed Oct. 22, 2013, which are hereby incorporated by reference herein in their entirety.

What is claimed is:

1. A cleaning device comprising:

a cleaning unit configured to perform cleaning while in contact with a light transmission member, the cleaning unit being movable with respect to the transmission member in a first direction and a second direction differing in orientation; and a first cleaning portion and a second cleaning portion provided in the cleaning unit and capable of coming into contact with the transmission member, wherein the cleaning unit moves in the first direction while keeping the first cleaning portion in contact with the transmission member and keeping the second cleaning portion away from the transmission member, and moves in the second direction while keeping the first cleaning portion away from the transmission member and keeping the second cleaning portion in contact with the transmission member.

2. The cleaning device according to claim 1, wherein the first direction and the second direction are directions parallel to each other.

3. The cleaning device according to claim 1, wherein each of the first cleaning portion and the second cleaning portion is a cleaning portion configured to scrape off foreign matter on the transmission member by moving while in contact with the transmission member.

4. The cleaning device according to claim 1, wherein each of the first cleaning portion and the second cleaning portion is a sheet-like or blade-like cleaning portion.

5. The cleaning device according to claim 4, wherein, while the cleaning unit is moving in the first direction with respect to the transmission member, the first cleaning portion is in contact with the transmission member in a state that a leading edge of the first cleaning portion is disposed at downstream to the other portion of the first cleaning portion with respect to the first direction, and while the cleaning unit is moving in the second direction with respect to the transmission member, the second cleaning portion is in contact with the transmission member in a state that a leading edge of the second cleaning portion is disposed at downstream to the other portion of the second cleaning portion with respect to the second direction.

6. A cleaning device comprising:

a cleaning unit configured to perform cleaning while in contact with a light transmission member, the cleaning unit being movable with respect to the transmission member in a first direction and a second direction differing in orientation;

a moving member provided in the cleaning unit and movable in the first direction and the second direction within an image forming apparatus main body; and a cleaning portion provided in the cleaning unit and capable of being changed in position with respect to the moving member, the cleaning portion being a sheet-like or blade-like cleaning portion, wherein the positions of the cleaning portion with respect to the moving member when the cleaning unit is moving in the first direction differ from those when the cleaning unit is moving in the second direction, while the cleaning unit is moving in the first direction with respect to the transmission member, the cleaning portion is in contact with the transmission member in a state that a leading edge of the cleaning portion is disposed at downstream to the other portion of the cleaning portion with respect to the first direction and a first surface of the cleaning portion is opposed to the transmission member, and while the cleaning unit is moving in the second direction with respect to the transmission member, the cleaning portion is in contact with the transmission member in a state that a leading edge of the cleaning portion is disposed at downstream to the other portion of the cleaning portion with respect to the second direction and a second surface of the cleaning portion that is an opposite surface of the first surface is opposed to the transmission member.

7. An image forming apparatus comprising:

a transmission member;

a light irradiation device configured to apply the light transmitted through the transmission member to a photosensitive member to form an image by causing toner to adhere to the irradiated photosensitive member;

a cleaning unit configured to perform cleaning while in contact with a transmission member, the cleaning unit being movable with respect to the transmission member in a first direction and a second direction differing from the first direction; and a first cleaning portion and a second cleaning portion provided in the cleaning unit and capable of coming into contact with the transmission member, wherein the cleaning unit moves in the first direction while keeping the first cleaning portion in contact with the transmission member and keeping the second cleaning portion away from the transmission member, and moves in the second direction while keeping the first cleaning portion away from the transmission member and keeping the second cleaning portion in contact with the transmission member.

8. The image forming apparatus according to claim 7, further comprising:

an insertion/extraction member that can be inserted into and extracted from the image forming apparatus main body, wherein the transmission member is fixed to the image forming apparatus main body, and the cleaning unit moves while being engaged with the insertion/extraction member, and wherein the cleaning unit moves in the first direction when the insertion/extraction member is inserted into the image forming apparatus main body, and moves in the second direction when the insertion/extraction member is extracted from the image forming apparatus main body.

9. The image forming apparatus according to claim 8, wherein the insertion/extraction member is equipped with a first contact portion capable of moving the cleaning unit in the first direction and the second direction while in contact with the cleaning unit, and a second contact portion provided on the upstream side in the first direction of the first contact portion and capable of moving the cleaning unit in the first direction while in contact with the cleaning unit.

10. The image forming apparatus according to claim 8, wherein the insertion/extraction member is a cartridge equipped with the photosensitive member and a process unit configured to act on the photosensitive member.

11. The image forming apparatus according to claim 10, wherein the process unit acting on the photosensitive member is a developing unit configured to cause toner to adhere to the photosensitive member, and/or a cleaner configured to recover toner from the photosensitive member.

12. The image forming apparatus according to claim 11, further comprising a guide member configured to guide insertion and extraction of the cartridge into and from the image forming apparatus main body, wherein the cleaning unit is movably supported by the guide member.

13. The image forming apparatus according to claim 7, wherein the first direction and the second direction are parallel to a rotation axis direction of the photosensitive member.

14. The image forming apparatus according to claim 7, further comprising:

a moving member provided in the cleaning unit and movable in the first direction and the second direction within the image forming apparatus main body; and a swinging member supported so as to be swingable with respect to the moving member, wherein the first cleaning portion and the second cleaning portion are provided on the swinging member.

15. The image forming apparatus according to claim 7, wherein the transmission member can be inserted into and extracted from the image forming apparatus main body, and the cleaning unit is fixed to the image forming apparatus main body, and wherein the cleaning unit moves in the first direction with respect to the transmission member when the transmission member is extracted from the image forming apparatus main body, and moves in the second direction with respect to the transmission member when the transmission member is inserted into the image forming apparatus main body.

16. The image forming apparatus according to claim 7, further comprising a casing provided in the light irradiation device and having an opening through which light to be applied to the photosensitive member passes, wherein the transmission member is provided opposite the opening.

17. The image forming apparatus according to claim 7, wherein the transmission member is arranged vertically below the photosensitive member.

18. The image forming apparatus according to claim 7, further comprising:

another photosensitive member;

another light transmission member, through which the light irradiation device applies the light to the other photosensitive member; and another cleaning unit configured to perform cleaning while in contact with the other transmission member, the other cleaning unit being movable in a first direction and a second direction differing in orientation with respect to the other transmission member, wherein the other cleaning unit is provided with the first cleaning portion and the second cleaning portion capable of coming into contact with the other transmission member, and wherein the other cleaning unit moves in the first direction while keeping the first cleaning portion into contact with the other transmission member and keeping the second cleaning portion away from the other transmission member, and moves in the second direction while keeping the first cleaning portion away from the other transmission member and keeping the second cleaning portion into contact the other transmission member.

19. A cleaning device comprising:

a cleaning unit configured to clean a transmission member for transmitting light, the cleaning unit including:

a moving member configured to move with respect to the transmission member in a first direction and a second direction differing from the first direction; and a cleaning portion supported by the moving member in a configuration that a position with respect to the moving member is changeable, wherein, in a case where a position of the cleaning portion with respect to the moving member is at a first position, the cleaning portion contacts with the transmission member, and in a case where a position of the cleaning portion with respect to the moving member is at a second position, the cleaning portion doesn't contact with the transmission member, wherein the transmission member is cleaned by the cleaning portion which is in contact with the transmission member according to the movement of the moving member in the first direction while the cleaning portion is at the first position, and wherein the cleaning portion is at the second position while the moving member moves in the second direction.

20. The cleaning device according to claim 19, wherein the cleaning portion includes a sheet-like or blade-like cleaning portion, and wherein, while the moving member is moving in the first direction with respect to the transmission member, the sheet-like or blade-like cleaning portion contacts with the transmission member in a state that a leading edge of the sheet-like or blade-like cleaning portion is disposed at downstream to the other portion of the sheet-like or blade-like cleaning portion with respect to the first direction.

21. The cleaning device according to claim 19, wherein the cleaning unit further including:

a swinging member supported so as to be swingable with respect to the moving member, wherein the cleaning portion is provided on the swinging member, and wherein a position of the cleaning portion with respect to the moving member is changed according to movement of the swinging member to swing with respect to the moving member.

22. An image forming apparatus comprising:

a transmission member;

a light irradiation device configured to apply the light transmitted through the transmission member to a photosensitive member to form an image by causing toner to adhere to the irradiated photosensitive member;

a cleaning unit configured to perform cleaning the transmission member, the cleaning unit including:

a moving member configured to move with respect to the transmission member in a first direction and a second direction differing from the first direction; and a cleaning portion supported by the moving member in a configuration that a position with respect to the moving member is changeable, wherein, in a case where a position of the cleaning portion with respect to the moving member is at a first position, the cleaning portion contacts with the transmission member, and in a case where a position of the cleaning portion with respect to the moving member is at a second position, the cleaning portion doesn't contact with the transmission member, wherein the transmission member is cleaned by the cleaning portion which is in contact with the transmission member according to the movement of the moving member in the first direction while the cleaning portion is at the first position, and wherein the moving member moves in the second direction while the cleaning portion is at the second position.

23. The image forming apparatus according to claim 22, further comprising an insertion/extraction member capable of being inserted into and extracted from the image forming apparatus main body, wherein the transmission member is fixed to the image forming apparatus main body, and the moving member moves in conjunction with insertion and extraction of the insertion/extraction member to and from the apparatus main body.

24. The image forming apparatus according to claim 23, further comprising:

a first contact portion provided on the insertion/extraction member and capable of moving the moving member in the first direction and the second direction while in contact with the cleaning unit; and a second contact portion provided on the insertion/extraction member and capable of moving the moving member in the first direction while in contact with the cleaning unit, wherein the second contact portion is provided on the upstream side in the first direction of the first contact portion.

25. The image forming apparatus according to claim 23, wherein the insertion/extraction member is a cartridge equipped with the photosensitive member and a process unit configured to act on the photosensitive member.

26. The image forming apparatus according to claim 25, wherein the process unit acting on the photosensitive member is a developing unit configured to cause toner to adhere to the photosensitive member, and/or a cleaner configured to recover toner from the photosensitive member.

27. The image forming apparatus according to claim 26, further comprising a guide member configured to guide the insertion and extraction of the cartridge into and from the image forming apparatus main body, wherein the moving member is movably supported by the guide member.

28. The image forming apparatus according to claim 22, wherein the first direction and the second direction are parallel to a rotation axis direction of the photosensitive member.

29. The image forming apparatus according to claim 22, wherein the cleaning unit further includes:

a swinging member supported so as to be swingable with respect to the moving member, wherein the cleaning portion is provided on the swinging member, a position of the cleaning portion with respect to the moving member is changed according to swinging motions of the swinging member with respect to the moving member.

30. The image forming apparatus according to claim 22, further comprising a casing provided in the light irradiation device and having an opening through which light to be applied to the photosensitive member passes, wherein the transmission member is provided opposite the opening.

31. The image forming apparatus according to claim 22, wherein the transmission member is arranged vertically below the photosensitive member.

32. The image forming apparatus according to claim 22, further comprising:

another transmission member, through which the light irradiation device applies the light to another photosensitive member;

another cleaning unit configured to perform cleaning the other transmission member, the other cleaning unit including:

another moving member configured to move in conjunction with insertion and extraction of the insertion/extraction member to and from the apparatus main body and movable with respect to the other transmission member in the first direction and the second direction; and another cleaning portion supported by the other moving member in a configuration that a position with respect to the other moving member is changeable, wherein, in a case where a position of the other cleaning portion with respect to the other moving member is at a first position, the other cleaning portion contacts with the other transmission member, and in a case where a position of the other cleaning portion with respect to the other moving member is at a second position, the other cleaning portion doesn't contact with the other transmission member, wherein the other transmission member is cleaned by the other cleaning portion which is in contact with the other transmission member according to the movement of the other moving member in the first direction while the other cleaning portion is at the first position, and wherein the other moving member moves in the second direction while the other cleaning portion is at the second position.

33. The image forming apparatus according to claim 22, wherein the moving member moves in the first direction when the insertion/extraction member is inserted into the image forming apparatus main body, and moves in the second direction when the insertion/extraction member is extracted from the image forming apparatus main body.

34. The image forming apparatus according to claim 22, wherein the first direction and the second direction are parallel to a rotation axis of the photosensitive member.

* * * * *